US012416209B2

(12) United States Patent
Hiorth

(10) Patent No.: US 12,416,209 B2
(45) Date of Patent: Sep. 16, 2025

(54) WELL TOOL COMPRISING AN ANCHORING DEVICE AND METHOD FOR USING

(71) Applicant: Interwell Norway AS, Hafrsfjord (NO)

(72) Inventor: Thomas Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 18/557,160

(22) PCT Filed: Apr. 21, 2022

(86) PCT No.: PCT/EP2022/060490
§ 371 (c)(1),
(2) Date: Oct. 25, 2023

(87) PCT Pub. No.: WO2022/228978
PCT Pub. Date: Nov. 3, 2022

(65) Prior Publication Data

US 2024/0209702 A1 Jun. 27, 2024

(30) Foreign Application Priority Data

Apr. 27, 2021 (NO) ..... 20210509

(51) Int. Cl.
*E21B 23/02* (2006.01)
*E21B 23/01* (2006.01)
*E21B 33/128* (2006.01)

(52) U.S. Cl.
CPC ..... *E21B 23/01* (2013.01); *E21B 33/128* (2013.01)

(58) Field of Classification Search
CPC ..... E21B 33/0422; E21B 33/05; E21B 23/02; E21B 23/01; Y10S 285/922
See application file for complete search history.

(56) References Cited

U.S. PATENT DOCUMENTS 1,367,156 A * 2/1921 McAlvay ..... E21B 33/05 285/391
2,401,119 A * 5/1946 Taylor, Jr. ..... E21B 34/08 285/276

(Continued)

FOREIGN PATENT DOCUMENTS

EP 1 116 860 A1 7/2001
WO 2016/028155 A1 2/2016

OTHER PUBLICATIONS

International Search Report issued in corresponding International Application No. PCT/EP2022/060490, mailed on Jul. 1, 2022 (5 pages).

(Continued)

*Primary Examiner* — Kenneth L Thompson
(74) *Attorney, Agent, or Firm* — Osha Bergman Watanabe & Burton LLP

(57) ABSTRACT

A well tool performs an operation in an oil/gas well. The well tool includes: a mandrel having a longitudinal direction and a radial direction perpendicular to the longitudinal direction; and an anchoring device for longitudinally locking the well tool to a bore including a lock groove. The anchoring device includes: a first ring arranged radially outside the mandrel; a second ring arranged radially outside the mandrel at a longitudinal distance from the first ring and movable in the longitudinal direction relative to the first ring; a spring element being substantially ring-shaped and arranged radially outside the mandrel; and a plurality of locking dogs distributed circumferentially on the spring element and located longitudinally between the first ring and the second ring. The anchoring device has a run state in which the first ring and the second ring are provided at an initial longitudinal distance from each other. The anchoring device has a set state in which the first ring and the second ring are provided at a shorter distance from each other, thereby (Continued)

wedging the locking dogs outwards in the radial direction. The spring element is configured to bias the locking dogs inwards in the radial direction towards the run state of the anchoring device.

6 Claims, 14 Drawing Sheets

(56) References Cited

U.S. PATENT DOCUMENTS

| | | | | | |
|---|---|---|---|---|---|
| 3,749,166 | A | | 7/1973 | Young | |
| 4,058,162 | A | * | 11/1977 | Smith | E21B 34/02 166/135 |
| 4,345,649 | A | | 8/1982 | Baugh et al. | |
| 4,405,017 | A | * | 9/1983 | Allen | E21B 33/12 166/135 |
| 4,480,688 | A | | 11/1984 | Rundell et al. | |
| 4,750,559 | A | | 6/1988 | Greenlee et al. | |
| 5,542,473 | A | | 8/1996 | Pringle | |
| 6,457,749 | B1 | * | 10/2002 | Heijnen | E21B 34/10 285/308 |
| 8,613,324 | B2 | * | 12/2013 | Nguyen | E21B 33/04 166/208 |
| 11,952,847 | B2 | * | 4/2024 | Tolley | E21B 47/16 |
| 12,173,580 | B2 | * | 12/2024 | Larsen | E21B 33/129 |
| 2008/0041583 | A1 | | 2/2008 | Angman et al. | |
| 2018/0313184 | A1 | | 11/2018 | Merron et al. | |
| 2024/0191593 | A1 | * | 6/2024 | Larsen | E21B 23/02 |

OTHER PUBLICATIONS

Written Opinion issued in corresponding International Application No. PCT/EP2022/060490, mailed on Jul. 1, 2022 (9 pages).

Search Report issued in counterpart Norwegian Patent Application No. 20210509 mailed on Nov. 22, 2021 (2 pages).

* cited by examiner

SECTION A-A

SECTION B-B

WELL TOOL COMPRISING AN ANCHORING DEVICE AND METHOD FOR USING

TECHNICAL FIELD

The invention relates to a well tool for performing an operation in an oil/gas well, in particular to a well tool to be locked in a spool such as a cement spool, and a method of using same.

BACKGROUND

Cement spool straddles are used to protect the valves of a Xmas tree from cement during a cementing job on vertical and horizontal Xmas tree subsea wells. The cement is pumped through the inlet hole of a cement spool, which is placed on top of a permanent subsea installation. Packer element can be used to ensure that cement is guided from the cement spool inlet through the centre of the cement spool straddle and down into a spacer pipe which protrudes down below the Xmas three valves. To achieve this cement flow, the cement spool straddle must be aligned longitudinally with the cement spool. To pump Sponge Foam Wiper Balls into the cement spool straddle in front of and behind the cement column, the cement spool straddle must also be rotationally aligned with the cement spool. Once aligned the cement spool straddle can be anchored to the cement spool. Several anchoring mechanisms have been proposed.

US20180313184A1 discloses A wellbore isolation device includes an elongate mandrel, a sealing element carried by the mandrel, and a slip wedge positioned about the mandrel longitudinally adjacent the sealing element and providing an outer radial surface. A set of slip segments is circumferentially disposed about the mandrel and at least a portion of the slip wedge. An extrusion limiting ring has an annular body that provides a first longitudinal end, a second longitudinal end, and a scarf cut extending at least partially between the first and second longitudinal ends. The extrusion limiting ring is movable between a contracted state, where the extrusion limiting ring is disposed about the sealing element, and an expanded state, where the extrusion limiting ring is disposed about the outer radial surface of the lower slip wedge. The extrusion limiting ring is used to mitigate or prevent extrusion of the material of the sealing element.

An objective of the present invention is to provide an anchoring device for a well tool that are simplified compared to the prior art.

SUMMARY OF THE INVENTION

The invention is set forth in the independent claims and the dependent claims describe certain optional features of the invention.

The present invention relates to a well tool for performing an operation in an oil/gas well, wherein the well tool comprises:

- a mandrel having a longitudinal direction and a radial direction perpendicular to the longitudinal direction; and
- an anchoring device for longitudinally locking the well tool to a bore comprising a lock groove;

wherein the anchoring device comprises:

- a first ring arranged radially outside the mandrel;
- a second ring arranged radially outside the mandrel at a longitudinal distance from the first ring and movable in the longitudinal direction relative to the first ring;

- a spring element being substantially ring-shaped and arranged radially outside the mandrel; and
- a plurality of locking dogs distributed circumferentially on the spring element and located longitudinally between the first ring and the second ring;

wherein the anchoring device has a run state in which the first ring and the second ring are provided at an initial longitudinal distance from each other; and wherein the anchoring device has a set state in which the first ring and the second ring are provided at a shorter distance from each other, thereby wedging the locking dogs outwards in the radial direction;

wherein the spring element is configured to bias the locking dogs inwards in the radial direction towards the run state of the anchoring device.

The set state of the anchoring device may be configured to prevent longitudinal movement of the well tool relative to a surrounding bore. The set state of the anchoring device may also be configured to prevent rotational movement of the well tool relative to the surrounding bore.

The biasing force from the first ring and the second ring on the locking dogs may be increased by a reduction of the initial longitudinal distance between the first ring and the second ring. The biasing force from the first ring and the second ring on the locking dogs may be reduced by an increase of the longitudinal distance between the first ring and the second ring. The longitudinal distance between the first ring and the second ring in the run state of the anchoring device will typically be greater than the longitudinal distance between the first ring and the second ring in the set state of the anchoring device.

The first ring and/or the second ring may have a chamfered edge configured to engage the locking dogs and force the locking dogs outwards in a radial direction.

The locking dogs may also have one or several chamfered edges configured to engage the first ring and/or the second ring and force the locking dogs outwards in a radial direction. The first ring and the second ring may be moved closer to each other in response to a longitudinal force, and away from each other in response to an opposite longitudinal force.

In the set state of the anchoring device, a portion of the first ring and/or the second ring may partly or fully extend between the mandrel and the locking dogs.

Also in the run state of the anchoring device, a portion of the first ring and/or the second ring may partly or fully extend between the mandrel and the locking dogs. These portions may form a support preventing movement of the locking dogs inwards in the radial direction beyond a predetermined position. The mandrel may also form a support preventing movement of the locking dogs inwards in the radial direction beyond a predetermined position. Alternatively, a separate support element may be arranged to prevent movement of the locking dogs inwards in the radial direction beyond a predetermined position.

The distance between the first ring and the second ring may be zero in the set state of the anchoring device, i.e. the first ring and the second ring may be in contact with each other.

The anchoring device may be configured such that the set state of the anchoring device is achieved when the distance between the first ring and the second ring is within a predetermined interval. Preferably, the locking dogs are not moved radially when the distance is changed within the predetermined interval. This may e.g. be controlled by means of the thickness of the first ring and the second ring or by the thickness of the portion of the first ring and the second ring extending between the mandrel and the locking dogs. An advantage of such configuration is that the set state of the anchoring device can be maintained in the event of an increase in the distance between the first ring and the second ring caused by external factors such as changing temperatures or pressures.

The spring element will typically be extended in the set state of the anchoring device. The spring element may retract when returning to the run state of the anchoring device, which will cause the locking dogs to retract again.

The spring element and the locking dogs may together form a substantially ring-shaped locking mechanism.

The spring element can prevent unintentional radial movement of the locking dogs and thus keep them in place, also when the locking dogs are incorrectly positioned.

The locking dogs are designed to be engaged into a recess, a groove, compartments or similar in a surrounding bore in the set state of the anchoring device. The surrounding bore may e.g. be on a cement spool. And the well tool may e.g. be a cement spool straddle.

During operation, all forces generated by differential pressures are transferred to the bore through the locking dogs keeping the well tool stationary in the set state.

One spring element will typically connect all the locking dogs.

The locking dogs may be slidably distributed on the spring element.

The well tool is preferably connected to topside in a swivelling manner.

The well tool is preferably installed by means of a wireline.

In one aspect, the spring element may have a first end portion and a second end portion, wherein the first end portion is overlapping the second end portion in the longitudinal direction or the radial direction in both the run state and the set state of the anchoring device.

In one aspect, the spring element may be a plate spring.

An advantage of a flat spring is that it may have a relatively small radial extent. The strength of the flat spring may be increased by increasing its longitudinal extent without increasing its radial extent.

In one aspect, each locking dogs may comprise a through hole; and the spring element extends through the through holes of the locking dogs.

Both the first end portion and the second end portion of the spring element may preferably extend through the same through hole, or at least extend into the same through hole.

The spring element may thus connect the locking dogs without fasteners or bonding.

The locking dogs may be connected to the spring element in a slidable manner. The locking dogs may e.g. slide along the spring element when going from the run state of the anchoring device to the set state, or vice versa.

By adjusting the size of the through hole relative to the size of the spring element, there may be some play between the locking dogs and the spring element.

In one aspect, the spring element may have a first circumference in the run state and a second circumference in the set state; and an overlap between the first end portion and the second end portion has an extent of at least the difference between the first circumference and the second circumference of the spring element.

The overlap may then allow the spring element to be expanded into the set state of the anchoring device without the ends of the spring element being pulled out from the through hole of the locking dogs.

One of the ends of the spring element being pulled out of one or several locking dogs may represent a risk of not being able to retract the anchoring device to the run state.

In one aspect, the first end portion and the second end portion of the spring element may be tapered.

Alternatively, the first end portion could be provided radially outside or radially inside the second end portion.

Longitudinal tapering of the first end portion and the second end portion will allow an overlap in the longitudinal direction. The first end portion and the second end portion of the spring element may then overlap without requiring a larger through hole in one or several of the locking dogs than the parts of the spring element without overlap. The risk of the spring element snagging one of the locking dogs is thus reduced.

In one aspect, the well tool may further comprise:

a guide sleeve comprising a plurality of circumferentially distributed through-holes for positioning of the locking dogs.

An advantage of the guide sleeve is that the locking dogs may be evenly distributed along the circumference of the well tool in order to ensure even locking of the well tool and thus evenly distributed forces when in the set state.

In one aspect, one of the locking dogs may be secured to the spring element by means of a fastener.

An advantage of fastening one of the locking dogs to the spring element is that the spring element will not rotate relative to the locking dogs. In this way the ends of the spring element can be positioned relative to the locking dogs, e.g. such that both ends of the spring element are located within a through-hole of a given locking dog in both the run state and the set state.

In one aspect, the well tool may further comprise:

an outer housing arranged radially outside the mandrel;

an orientation system for longitudinal and rotational orientation of the well tool when inserted into a bore comprising a guide groove;

wherein the orientation system comprises:

a radial opening provided in the outer housing;

a finger sleeve comprising a longitudinally extending resilient finger with a distal part and a proximal part connected to the finger sleeve; wherein the finger sleeve is arranged radially between the mandrel and the outer housing;

wherein the distal part comprises a first wedge-shaped portion and a second wedge-shaped portion both extending in the outwards radial direction and tapering away from each other in the longitudinal direction;

wherein the orientation system has an initial state in which the first wedge-shaped portion protrudes radially through the radial opening of the outer housing and is configured to engage a guide groove in an inner surface of a surrounding bore;

wherein the first wedge-shaped portion is configured to be longitudinally and rotationally guided in the guide groove when the well tool is moved longitudinally;

wherein the well tool is configured to rotate with the first wedge-shaped portion;

wherein the orientation system has a subsequent state in which the first wedge-shaped portion is radially retracted in the radial opening of the outer housing.

The run state of the well tool is configured for running the well tool into the bore and aligning it relative to a reference in the bore.

When the well tool has been aligned in the bore, it is ready to be set, i.e. locked in place in the bore. In the set state of the well tool, the anchoring device is in the extended state in order to lock the well tool to the bore. In the set state of the well tool, the orientation system does no longer need to be in its initial state because the well tool is then held in place by the anchoring device. The orientation system can therefore enter its subsequent state. By combining the entry of the orientation system into the subsequent state with the entry of the anchoring device into the expanded state, the operation of the well tool is simplified.

The initial state of the orientation system enables the tool to be longitudinally and rotationally aligned as dictated by the guide groove of the surrounding bore. This alignment may e.g. cause an inlet in the well tool to align with an inlet in the bore.

The first wedge-shaped portion and the second wedge-shaped portion may be one piece or separate pieces.

The first wedge-shaped portion and the finger sleeve may be one piece or separate pieces.

The second wedge-shaped portion and the finger sleeve may be one piece or separate pieces.

The first wedge-shaped portion, the second wedge-shaped portion, and the finger sleeve may be one piece or separate pieces.

The first wedge-shaped portion may incline in a straight or a curved manner.

The second wedge-shaped portion may incline in a straight or a curved manner.

The first wedge-shaped portion may be arranged to incline in the longitudinal direction of the finger sleeve towards or away from the distal part of the resilient finger.

The well tool may be moved in a first longitudinal direction from topside towards the bottom hole. This first longitudinal direction may be referred to as an inserting direction.

The well tool may be moved in a second longitudinal direction from the bottom hole towards topside. This second longitudinal direction may be referred to as a pulling direction. The pulling direction being opposite the inserting direction.

The orientation system may allow a well tool to move in a inserting direction of a surrounding bore e.g. of a well or a cement spool. While running the tool in the inserting direction of the bore, a reduction in the bore diameter will cause an inwards force in the radial direction on the resilient finger due to the inclination of the first wedge-shaped portion. Due to its resilience, the resilient finger can bend inwards in the radial direction and allow the well tool to travel further into the well. The resilience of the resilient finger will also bias the first wedge-shaped portion outwards in the radial direction. The first wedge-shaped portion can therefore move outwards in the radial direction in response to an increase in the bore diameter.

The well tool will preferably enter the bore while moving in the inserting direction which may be referred to as the insertion direction.

In the subsequent state of the orientation system the first wedge-shaped portion is retracted and no longer in engagement with the guide grove circumferentially provided in the surrounding bore.

The subsequent state of the orientation system allows the well tool to move in both the inserting direction and the pulling direction without being held back by the first wedge-shaped portion.

The subsequent state of the orientation system is advantageous when retrieving the well tool.

The second wedge-shaped portion may be displaced inwards in the radial direction by the outer housing as a result of relative longitudinal movement between the finger sleeve and the outer housing. Engagement of the outer housing and the inclination of the second wedge-shaped portion may cause a force on the resilient finger inwards in the radial direction, thus bending the resilient finger inwards in the radial direction. The bending of the resilient finger inwards in the radial direction may allow the second wedge-shaped portion to be displaced inwards in the radial direction enough to engage an inner surface of the outer housing. The bending of the resilient finger inwards in the radial direction may preferably be sufficient to retract the first wedge-shaped portion in the radial opening of the outer housing, i.e. such that the first wedge-shaped portion no longer protrudes outside the radial opening.

The first wedge-shaped portion and the second wedge-shaped portion may be arranged with a gap between them in the longitudinal direction.

The orientation system may further comprise a shear pin preventing relative longitudinal movement between the outer housing and the finger sleeve when the orientation system is in the initial state. The shear pin may prevent an unintentional shift to the subsequent state of the orientation system.

The shear pin may be a shear disc or ball configured to break at a predetermined shear force value.

The finger sleeve may be substantially arranged radially between the mandrel and the outer housing.

The first wedge-shaped portion may be radially retracted in the radial opening of the outer housing by means of the second wedge-shaped portion being displaced inwards in the radial direction due to relative longitudinal movement between the outer housing and the finger sleeve.

The guide groove may be circumferentially provided in the surrounding bore.

The well tool may be configured such that the change of the rotational orientation of the first wedge-shaped portion cause a substantially equal change of the rotational orientation of the entire well tool.

In one aspect, the first wedge-shaped portion may have a stop surface extending outwards in the radial direction.

The stop surface may be orthogonal to the pulling direction.

The orientation system may prevent movement in a pulling direction of the surrounding bore past a sudden reduction in the bore diameter, e.g. a recess or grove with sharp corners. This is because no force is acting on the resilient finger inwards in the radial direction such that it is bent sufficiently inwards in the radial direction to pass the reduced bore diameter. A sharp corner in the bore, e.g. in the form of a circumferentially arranged guide grove, can thus hold back the resilient finger. As the resilient finger will not bend sufficiently inwards in the radial direction, the first wedge-shaped portion is forced to follow the guide grove as long as the tool is not moved in the inserting direction.

The radial opening in the outer housing may have a longitudinal length of at least the combined length of the first wedge-shaped portion and the second wedge-shaped portion.

The longitudinal extent of the radial opening thus allows the first wedge-shaped portion to extend through the radial opening while the outer housing moves a longitudinal distance relative to the finger sleeve at least equal to the longitudinal length of the second wedge-shaped portion. In this way the first wedge-shaped portion can extend through the hole while the second wedge-shaped portion is being displaced inwards in the radial direction by the outer housing.

The outer housing may further comprise a retention lip extending inwards in the radial direction for engagement with the second wedge-shaped portion when the orientation system is in the subsequent state.

The retention lip will prevent the orientation system from returning to the initial state after entering the subsequent state.

The retention lip will typically extend from an inner surface of the outer housing.

The retention lip may be part of a recess.

The first wedge-shaped portion and the finger sleeve may be separate pieces connected to each other by fastening means having a predetermined shear strength.

The resilient finger may thus be collapsed if a longitudinal force exceeds the predetermined shear force. It is thus provided a contingency for retrieving the well tool if the subsequent state of the orientation system cannot be entered.

The resilient finger may thus allow the operator to verify that the well tool has been aligned with the surrounding bore by means of pulling the well tool with a predetermined force below the shear force of the fastening means. No movement of the well tool in response to this pulling force may indicate that the well tool has been aligned.

The first wedge-shaped portion may in the radial direction have a first outwards extent, and the second wedge-shaped portion may in the radial direction have a second outwards extent, and the outer housing may have a given wall thickness. The difference between the first outwards extend and the second outwards extent is preferably less than the wall thickness.

It is thus achieved an orientation system that does not unintentionally enter the subsequent state as a result of the first wedge-shaped portion being forced inwards in a radial direction by a surface of the surrounding bore.

The outer housing may have a varying wall thickness. In that case the difference between the first outward extend of the first wedge-shaped portion and the second outward extent of the second wedge-shaped portion in the radial direction is preferably less than the wall thickness of the radial opening's circumference.

The retention lip may be a part of the wall thickness.

In one aspect, the outer housing and the first ring or the second ring may be configured for simultaneous movement and adapted for simultaneous activation of the subsequent state of the locating finger mechanism and the set state of the anchoring device.

It is achieved a well tool that can enter the set state in one operation.

The outer housing and the first ring or the second ring may be in direct contact with each other or indirectly in contact via one or several intermediate components. The outer housing and the first ring or the second ring may e.g. be connected by threads, shear pins, a box and pin connection. Alternatively, the outer housing and the first ring or the second ring may be the same component.

In one aspect, the well tool may further comprise:

an inlet hole for cement arranged in the mandrel; and a first packer and a second packer arranged on opposite sides of the inlet hole.

The first packer and the second packer may be configured to expand and seal against a surrounding bore in the set state of the well tool. The well tool may be configured to expand the packers simultaneously with the entering of the subsequent state of the orientation system and the set state of the anchoring device.

The well tool may further comprise: a finger coupling, a finger coupling support, and a ratchet.

The present invention also relates to a well tool system for performing an operation in an oil/gas well, wherein the well tool system comprises:

a well tool as described herein, wherein the well tool is a cement spool straddle; and a cement spool;

wherein the cement spool comprises:

a bore extending in a longitudinal direction of the cement spool and configured to receive the well tool; and a lock groove circumferentially provided in the bore and configured to receive the plurality of locking dogs of the well tool.

In one aspect, the well tool system may further comprise:

an inlet extending in the radial direction;

an outer housing arranged radially outside the mandrel;

an orientation system for longitudinal and rotational orientation of the well tool when inserted into a bore comprising a guide groove;

wherein the orientation system comprises:

a radial opening provided in the outer housing;

a finger sleeve comprising a longitudinally extending resilient finger with a distal part and a proximal part connected to the finger sleeve; wherein the finger sleeve is arranged radially between the mandrel and the outer housing;

wherein the distal part comprises a first wedge-shaped portion and a second wedge-shaped portion both extending in the outwards radial direction and tapering away from each other in the longitudinal direction;

wherein the orientation system has an initial state in which the first wedge-shaped portion protrudes radially through the radial opening of the outer housing and is configured to engage a guide groove in an inner surface of a surrounding bore;

wherein the first wedge-shaped portion is configured to be longitudinally and rotationally guided in the guide groove when the well tool is moved longitudinally;

wherein the well tool is configured to rotate with the first wedge-shaped portion;

wherein the orientation system has a subsequent state in which the first wedge-shaped portion is radially retracted in the radial opening of the outer housing.

wherein the cement spool further comprises:

an inlet extending from the bore in the radial direction to an outside of the cement spool; and a guide groove provided in an inner surface of the bore and configured to receive and guide the first wedge-shaped portion of the well tool;

wherein the guide groove comprises an upper point and a lower point that are spaced apart in the longitudinal direction of the cement spool;

wherein the guide groove extends from the lower point to the upper point in a substantially helical manner;

wherein the positioning of the upper point relative to the inlet of the cement spool matches the positioning of the first wedge-shaped portion relative to the inlet of the well tool in the initial state of the orientation system.

The guide groove may preferably be circumferentially provided in the bore, i.e. a continuous groove extending the entire circumference.

The guide groove may have portions deviating from the substantially helical extent, i.e. portions extending in the longitudinal direction.

The guide groove may have a plurality of upper points and lower points.

If the finger sleeve comprises a plurality of resilient fingers. The guide groove may preferably comprise a corresponding number of upper points and lower points. The finger sleeve may e.g. comprise two resilient fingers. Two resilient fingers may be circumferentially spaced apart 180°. The upper points should then preferably also be circumferentially spaced apart 180°. The lower points should then preferably also be circumferentially spaced apart 180°. A first part of the guide groove connecting a first upper point with a first lower point may preferably match a subsequent part of the guide groove connecting a subsequent upper point with a subsequent lower point. A well tool system comprising a well tool with two resilient fingers and a cement spool with two upper point may have two orientations of the well tool relative to the cement spool after alignment. The well tool may then have two inlets typically circumferentially spaced apart 180°.

The present invention also relates to a method for setting a well tool in a bore with a guide groove, wherein the well tool is a well tool as described herein, wherein the method comprises the steps of:

configuring the anchoring device to be in the run state;

inserting the well tool into a bore comprising an inner surface provided with a lock groove;

aligning the well tool with the lock groove of the bore; and setting the well tool by moving the first ring and the second ring towards each other until the anchoring device enters the set state.

In one aspect, the well tool may further comprise:

an outer housing arranged radially outside the mandrel;

an orientation system for longitudinal and rotational orientation of the well tool when inserted into a bore comprising a guide groove;

wherein the orientation system comprises:

a radial opening provided in the outer housing;

a finger sleeve comprising a longitudinally extending resilient finger with a distal part and a proximal part connected to the finger sleeve; wherein the finger sleeve is arranged radially between the mandrel and the outer housing;

wherein the distal part comprises a first wedge-shaped portion and a second wedge-shaped portion both extending in the outwards radial direction and tapering away from each other in the longitudinal direction;

wherein the orientation system has an initial state in which the first wedge-shaped portion protrudes radially through the radial opening of the outer housing and is configured to engage a guide groove in an inner surface of a surrounding bore;

wherein the first wedge-shaped portion is configured to be longitudinally and rotationally guided in the guide groove when the well tool is moved longitudinally;

wherein the well tool is configured to rotate with the first wedge-shaped portion;

wherein the orientation system has a subsequent state in which the first wedge-shaped portion is radially retracted in the radial opening of the outer housing, wherein the aligning of the well tool with the lock groove of the bore may comprise the steps of:

configuring the orientation system to be in the initial state;

running the well tool in an inserting direction through the bore at least until the first wedge-shaped portion reaches the guide groove of the bore;

pulling the well tool with a predetermined force in a pulling direction through the bore while allowing the well tool to swivel in the bore in response to a guiding interaction between the first wedge-shaped portion and the guide groove of the bore; and continue pulling the well tool with a predetermined force in the pulling direction through the bore until the well tool stops moving.

The alignment may e.g. be between an inlet in the well tool and an inlet in the surrounding bore.

When running the well tool in the inserting direction through the bore, the method will work if the first wedge-shaped portion just reaches the guide groove and also if the first wedge-shaped portion moves beyond the guide groove.

In one aspect, the outer housing and the first ring or the second ring may be configured for simultaneous movement and adapted for simultaneous activation of the subsequent state of the locating finger mechanism and the set state of the anchoring device;

wherein the setting of the well tool may comprise the step of:

setting the well tool by moving the first ring and the second ring towards each other until the orientation system enters the subsequent state and the anchoring device enters the set state.

With the anchoring mechanism in the set state, the orientation system is no longer needed and can be retracted. The operation of the tool is simplified by setting the anchor mechanism and retracting the orientation system in one step.

With the orientation system in the subsequent state, the orientation system will not prevent retrieval of the well tool.

In one aspect, the method comprises the steps of:

releasing the well tool by moving the first ring and the second ring away from each other until the anchoring device enters the run state; and retrieving the well tool from the bore.

The well tool may comprise a ratchet mechanism.

BRIEF DESCRIPTION OF THE DRAWINGS

The invention will now be described with reference to the exemplifying non-limiting embodiments shown in the accompanying drawings, wherein.

DETAILED DESCRIPTION OF A PREFERRED EMBODIMENT

Figure 1:
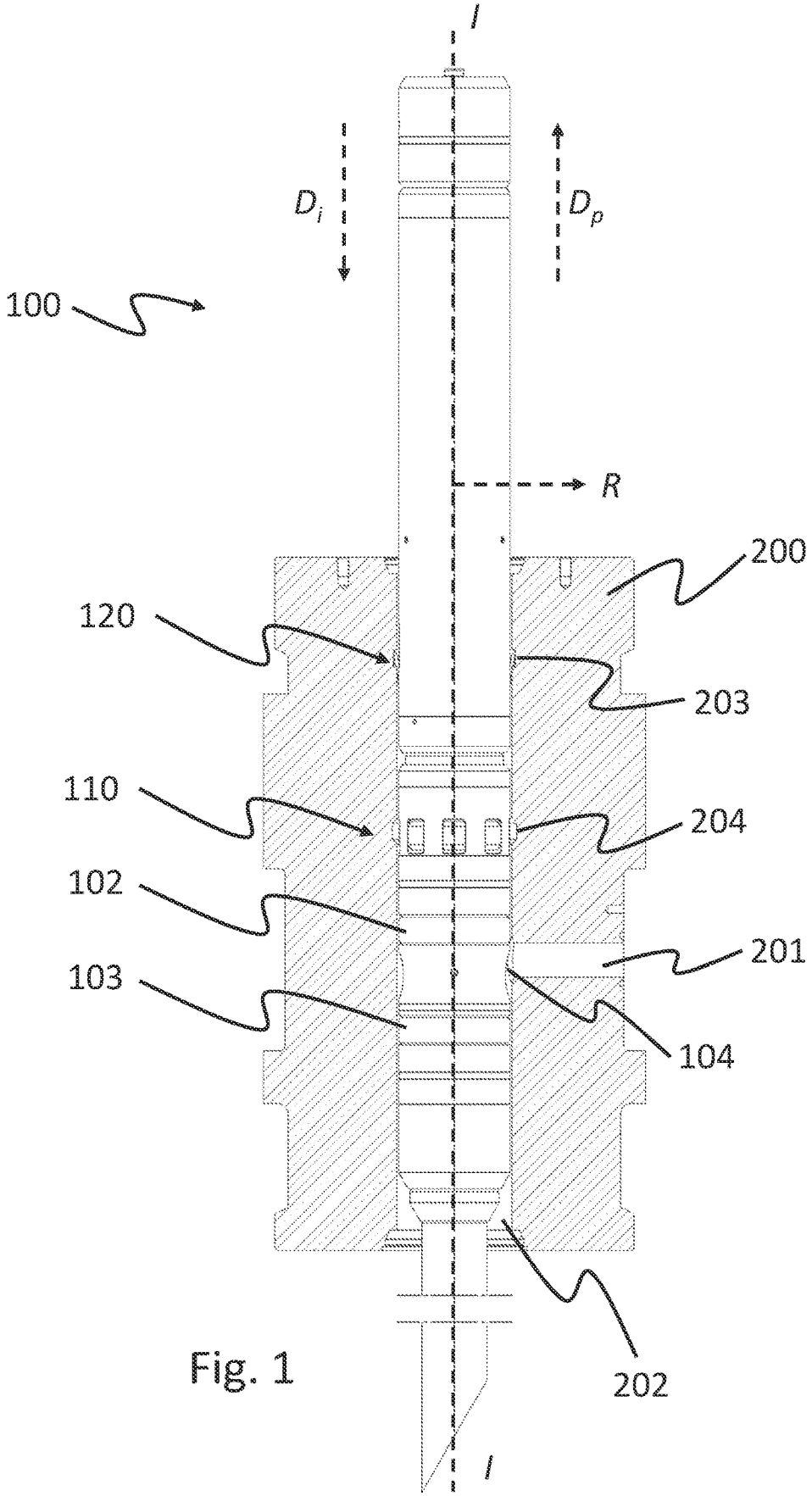
FIG. 1 shows a side view of a well tool comprising a orientation system and an anchoring device landed in and aligned with a spool shown in a cross-section.

FIG. 1 shows a side view of a well tool 100 arranged within a cement spool 200 shown in a cross-section.

The well tool 100 has a longitudinal direction I-I and a radial direction R orthogonal the longitudinal direction I-I.

The well tool 100 can be moved in a first longitudinal direction from topside towards the bottom hole. This first longitudinal direction may be referred to as an inserting direction Di.

The well tool 100 may be moved in a second longitudinal direction from the bottom hole towards topside. This second longitudinal direction may be referred to as a pulling direction Dp. The pulling direction Dp being opposite the inserting direction Di.

The cement spool 200 comprises a radially extending inlet 201 in fluid communication with a longitudinally extending bore 202. The cement spool 200 further comprises a guide groove 203 and a lock groove 204 arranged inside of the bore 202.

The well tool 100 may comprises an anchoring device 110 configured for locking engagement with the lock groove 204 of the cement spool 200, and/or an orientation system 120 configured for cooperation with the guide groove 203 of the cement spool 200.

When the well tool 100 comprises both the anchoring device 110 and the orientation system 120, then orientation system 120 can be adapted to align the anchoring device 110 with the lock groove 204.

The well tool 100 can further comprise an inlet 104 providing fluid communication between an outside of the well tool 100 and an inside of the well tool 100. A first packer 102 and a second packer 103 are normally arranged on opposite sides of the inlet 104 and configured to seal against the bore 202 of the cement spool 200.

When the well tool 100 comprises both the inlet 104 and the orientation system 120, then orientation system 120 can be adapted to align the inlet 104 of the well tool 100 with the inlet 201 of the cement spool 200. The orientation system 120 can be configured to align the inlet 104 of the well tool 100 and the inlet 201 of the cement spool 200 in the longitudinal direction I-I. The orientation system 120 can additionally be configured to align the inlet 104 of the well tool 100 and the inlet 201 of the cement spool 200 in the radial direction R.

When the well tool 100 comprises both the inlet 104 and the anchoring device 110, the inlet 104 of the well tool 100 will be aligned with the inlet 201 of the cement spool 200 when the anchoring device 110 is in locking engagement with the lock groove 204 of the cement spool 200.

When the well tool 100 comprises the inlet 104, the anchoring device 110, and the orientation system 120, the orientation system 120 can be configured to cooperate with the guide groove 203 of the cement spool 200 to align the inlet 104 of the well tool 100 with the inlet 201 of the cement spool 200, and at the same time align the anchoring device 110 with the lock groove 204 of the cement spool 200.

Figures 2A, 2B, 2C:
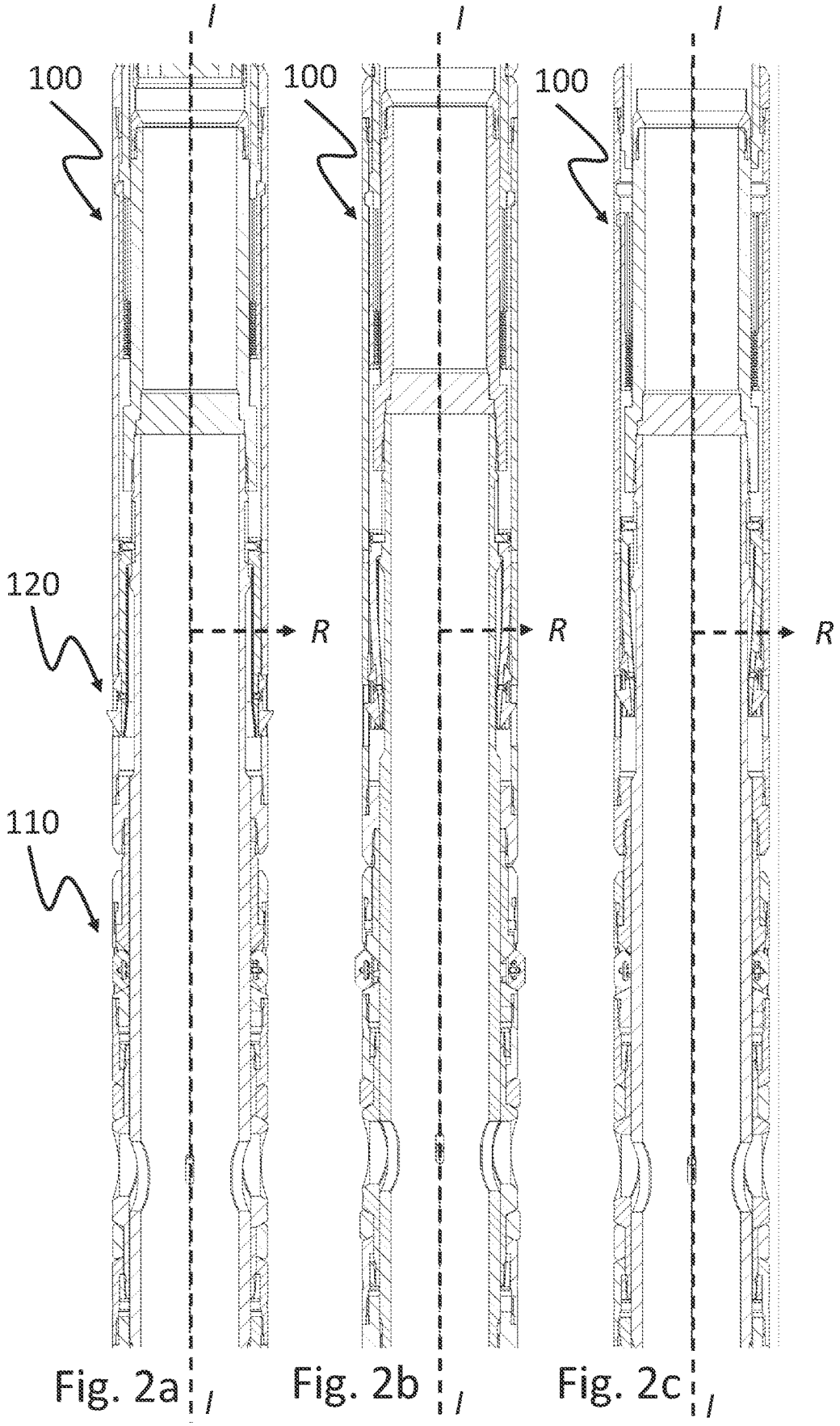
FIG. 2*a* shows a cross-section of the well tool in a run state in which the orientation system is in an initial state and the anchoring device is in a run state.
FIG. 2*b* shows a cross-section of the well tool in a set state in which the orientation system is in a subsequent state and the anchoring device is in a set state.
FIG. 2*c* shows a cross-section of the well tool in a retrieval state in which the orientation system is in the subsequent state and the anchoring device is in the run state.

FIG. 2*a*, FIG. 2*b* and FIG. 2*c* show cross-sections of the well tool 100.

In FIG. 2*a* the well tool 100 is in a run state wherein the orientation system 120 is in an initial state and the anchoring device 110 is in a run state. This configuration allows the well tool 100 to be entered into the cement spool 200 and to be oriented relative to the cement spool 200.

In FIG. 2*b* the well tool 100 is in a set state in which the orientation system 120 is in a subsequent state and the anchoring device 110 is in a set state. This configuration prevents at least longitudinal movement of the well tool 100 relative to the cement spool 200.

In FIG. 2*c* the well tool 100 is in a retrieval state in which the orientation system 120 is in the subsequent state and the anchoring device is in the run state. This configuration allows the well tool 100 to be retrieved from the cement spool 200.

Figure 3A:
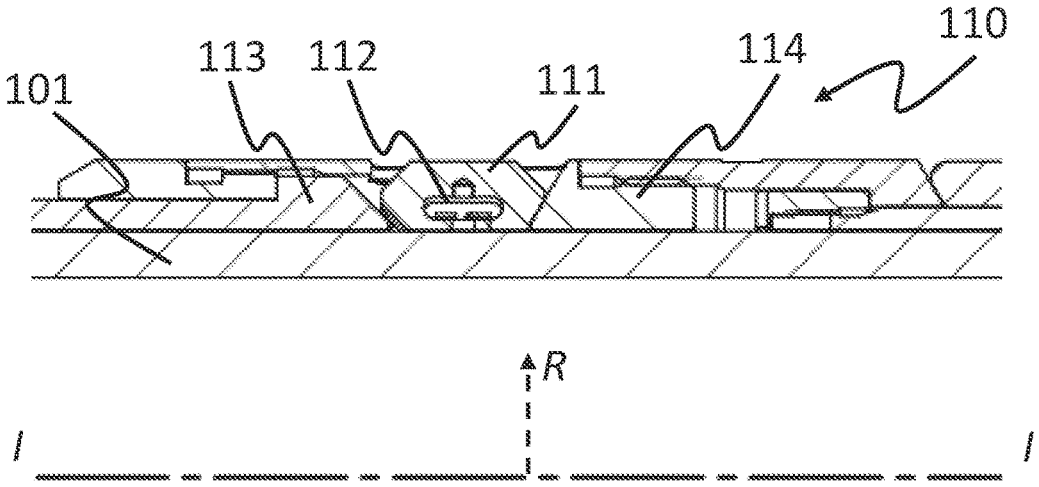
FIG. 3*a* shows a detailed cross-section of the anchoring device of the well tool in the run state.
Figure 3A:
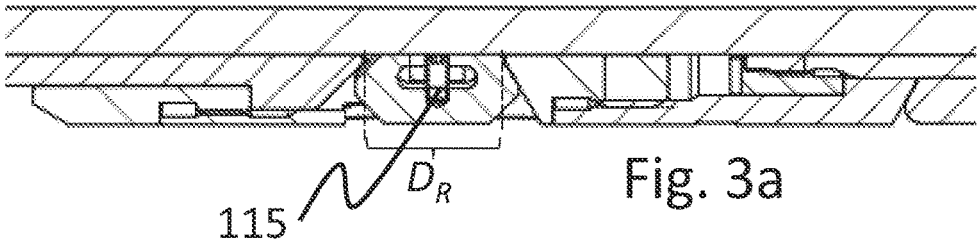
Figure 3B:
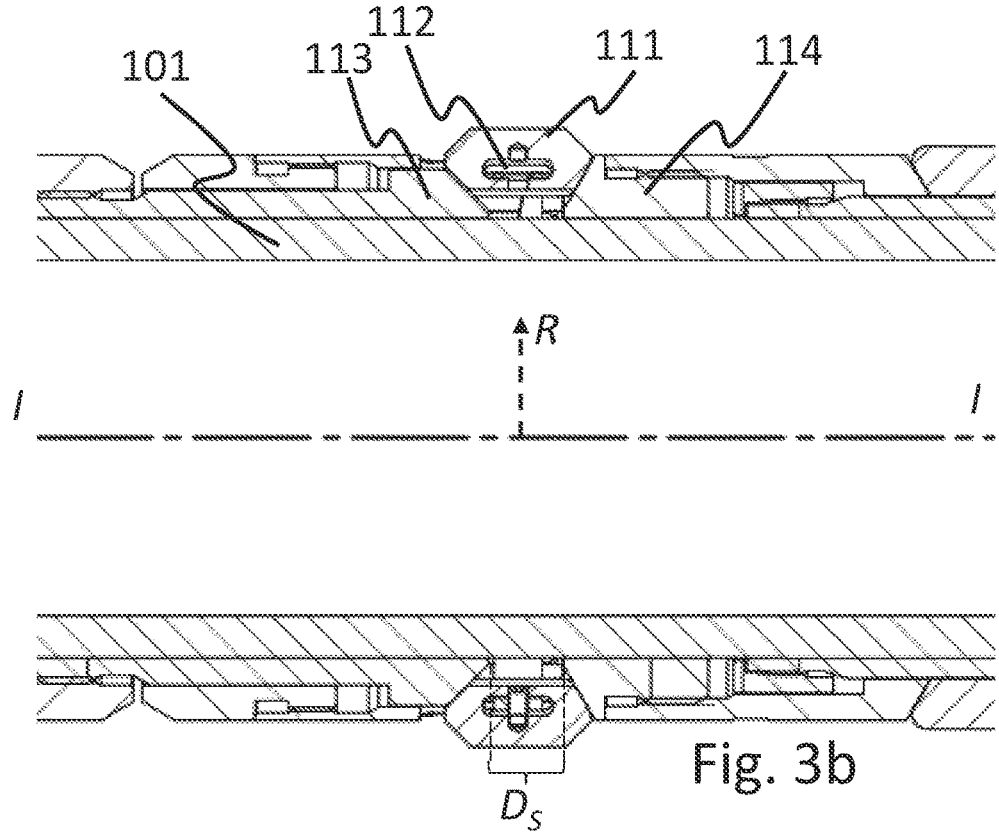
FIG. 3*b* shows a detailed cross-section of the anchoring device of the well tool in the set state.

FIG. 3*a* and FIG. 3*b* show cross-sections of the anchoring device 110 of the well tool 100. In FIG. 3*a* the anchoring device 110 is in the run state and in FIG. 3*b* the anchoring device 110 is in the set state.

The well tool 100 comprises a mandrel 101 having a longitudinal direction I-I and a radial direction R perpendicular to the longitudinal direction I-I.

The anchoring device 110 comprises a first ring 113 arranged radially outside the mandrel 101 and a second ring 114 arranged radially outside the mandrel 101 at a longitudinal distance from the first ring 113 and movable in the longitudinal direction I-I relative to the first ring 113.

The anchoring device 110 further comprises a spring element 112 substantially ring-shaped and arranged radially outside the mandrel 101, and a plurality of locking dogs 111 distributed circumferentially on the spring element 112 and located longitudinally between the first ring 113 and the second ring 114. Locking dogs 111 may be connected to the spring element 112 by means of a fastener 115.

In the run state of the anchoring device 110 illustrated in FIG. 3*a*, the first ring 113 and the second ring 114 are arranged at an initial longitudinal distance $D_R$ from each other.

In the set state of the anchoring device 110 illustrated in FIG. 3*b*, the first ring 113 and the second ring 114 are arranged at a shorter distance $D_S$ from each other and thereby wedging the locking dogs 111 outwards in the radial direction R.

The spring element 112 is configured to bias the locking dogs 111 inwards in the radial direction R, i.e. towards the run state of the anchoring device 110.

The first ring 113 and the second ring 114 can interface the locking dogs 111 with chamfered edges causing a longitudinal force applied the first ring 113 and/or the second ring 114 to apply a radially outwards directed force on the locking dogs 111.

Figure 4:
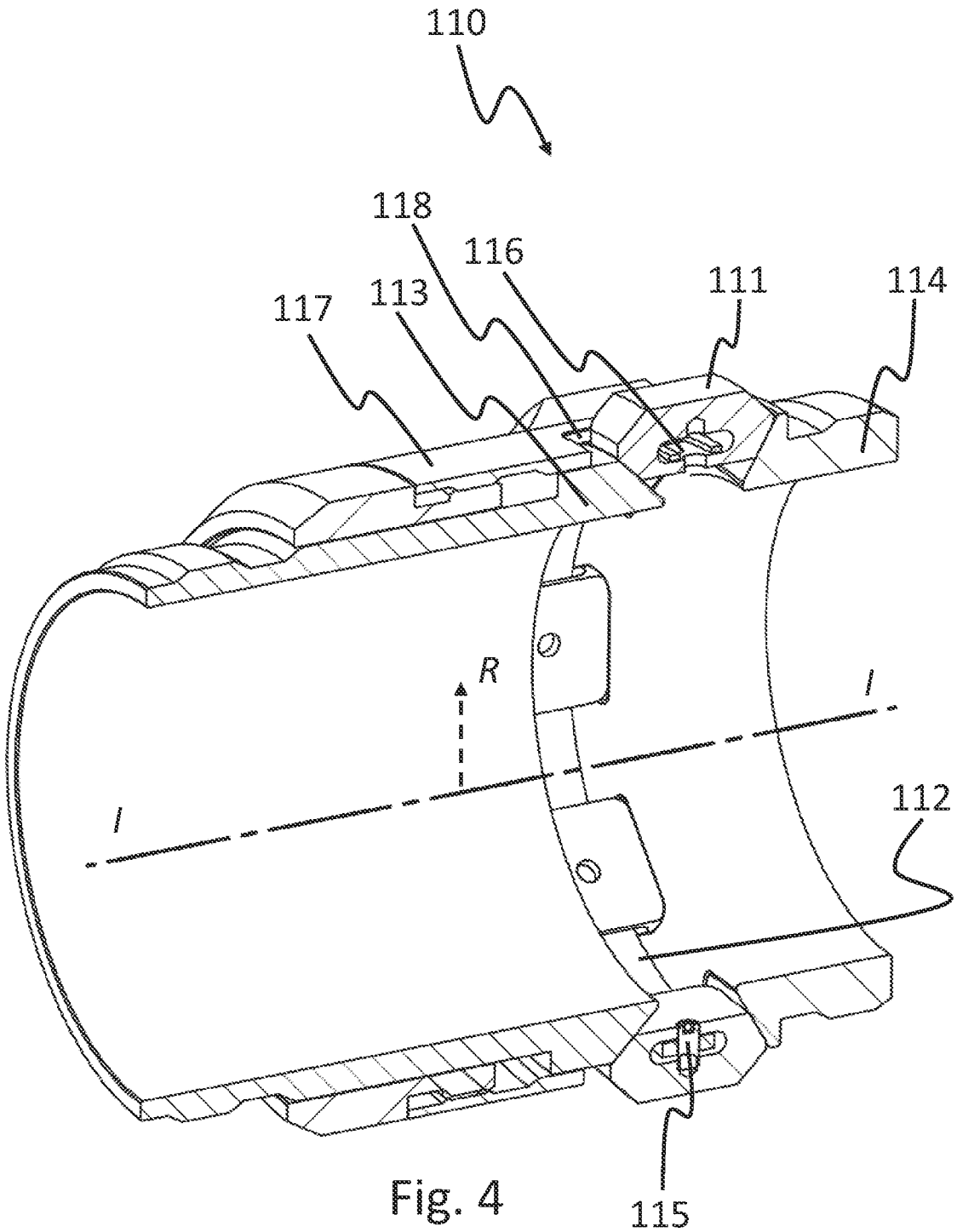
FIG. 4 shows a perspective cross-section of the anchoring device comprising locking dogs, a spring element, a first ring and a second ring.

FIG. 4 shows a perspective cross-section of the anchoring device 110. In FIG. 4 a guide sleeve 117 is arranged radially outside the mandrel 101 and the first ring 113. The guide sleeve 117 comprises a plurality of circumferentially distributed through-holes 118 adapted to allow the locking dogs 111 to protrude therethrough and for positioning of the locking dogs 111.

In FIG. 4 it is illustrated how the first ring 113 may have a continuous chamfered edge and the second ring 114 may have a partitioned chamfered edge. The chamfered partitions of the second ring 114 may have a size configured to receive one locking dog 111, as illustrated, or several locking dogs 111.

The locking dogs 111 may comprise a through-hole 116. The spring element 112 may extend through the through-hole 116 of each locking dog 111 and thus retain the locking dogs 111 in the radial direction.

Figure 5A:
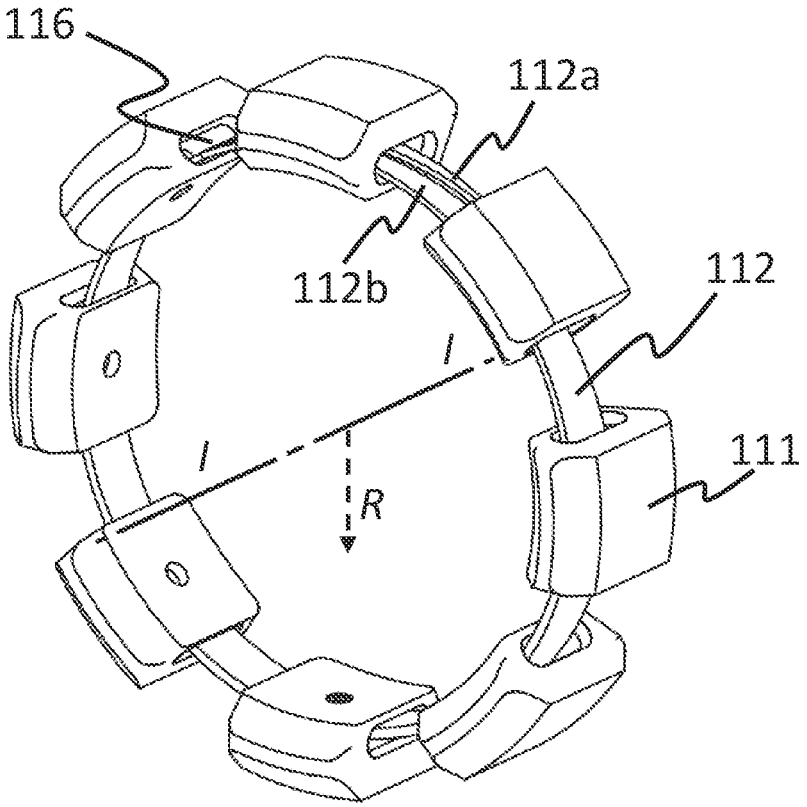
FIG. 5*a* shows a perspective view of locking dogs arranged on the spring element in a typical run state.
Figure 5B:
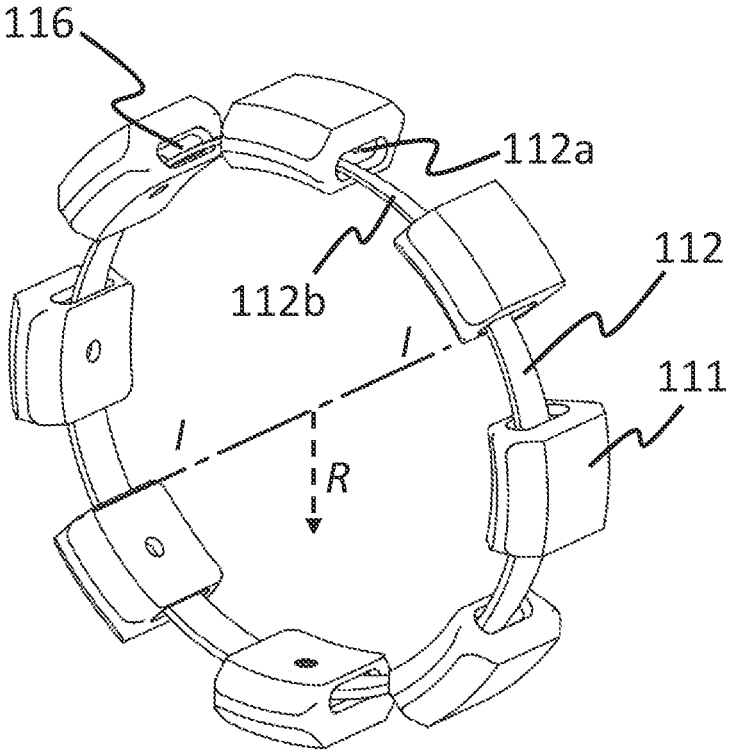
FIG. 5*b* shows a perspective view of locking dogs arranged on the spring element in a typical set state.

FIG. 5*a* and FIG. 5*b* show perspective views of locking dogs 111 arranged on the spring element 112. In FIG. 5*a* the spring element 112 is in a typical run state of the anchoring device 110 and in FIG. 5*b* the spring element 112 is in a typical set state of the anchoring device 110.

The spring element 112 has a first end portion 112*a* and a second end portion 112*b*. This allows the locking dogs 111 to be entered onto the spring element 112. In FIG. 5*a* and FIG. 5*b*, the first end portion 112*a* is overlapping the second end portion 112*b* in the longitudinal direction I-I, preferably in both the run state and the set state of the anchoring device 110.

The illustrated spring element 112 is a plate spring.

The illustrated first end portion 112*a* and second end portion 112*b* of the spring element 112 are tapered.

The spring element 112 has a first circumference in the run state illustrated in FIG. 5*a* and a second circumference in the set state illustrated in FIG. 5*b*, wherein the second circumference is greater than the first circumference. The overlap between the first end portion 112*a* and the second end portion 112*b* preferably has an extent of at least the difference between the first circumference and the second circumference of the spring element 112. It is also preferred that the first end portion 112*a* is overlapping the second end portion 112*b* in both the run state and the set state of the anchoring device 110.

Figure 6A:
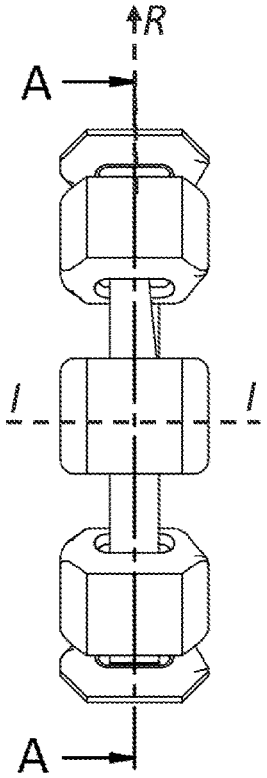
FIG. 6*a* shows a side view of locking dogs arranged on the spring element in a typical run state.
Figure 6B:
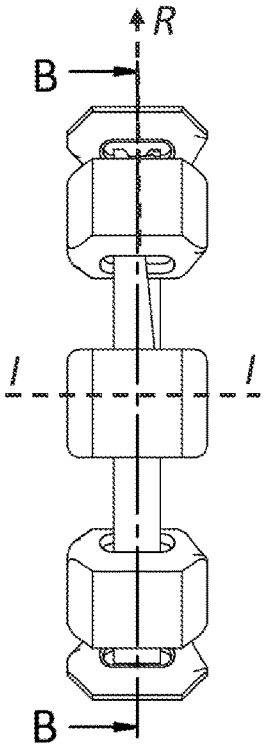
FIG. 6*b* shows a side view of locking dogs arranged on the spring element in a typical set state.

FIG. 6*a* and FIG. 6*b* show side views of locking dogs 111 arranged on the spring element 112. In FIG. 6*a* the spring element is in a typical run state and in FIG. 6*b* the spring element is in a typical set state.

Figure 7A:
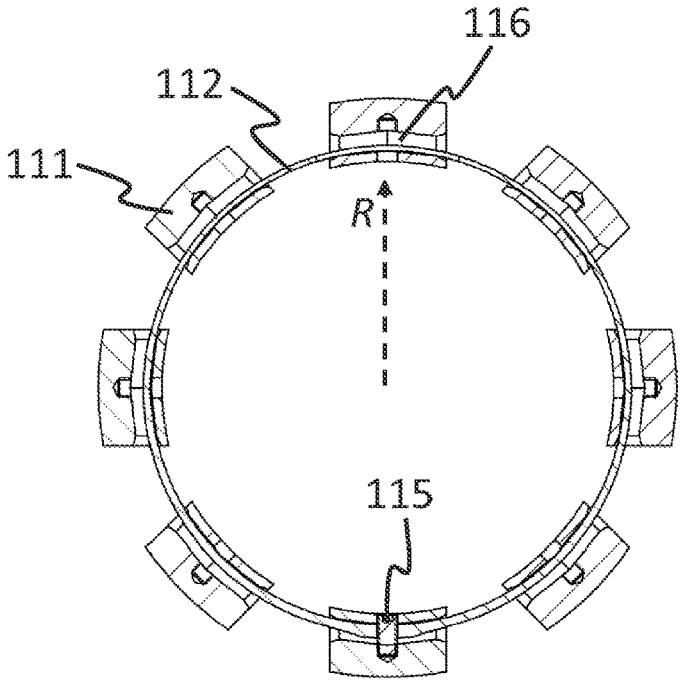
FIG. 7*a* shows a cross-section of the locking dogs and the spring element of FIG. 6*a;*
Figure 7B:
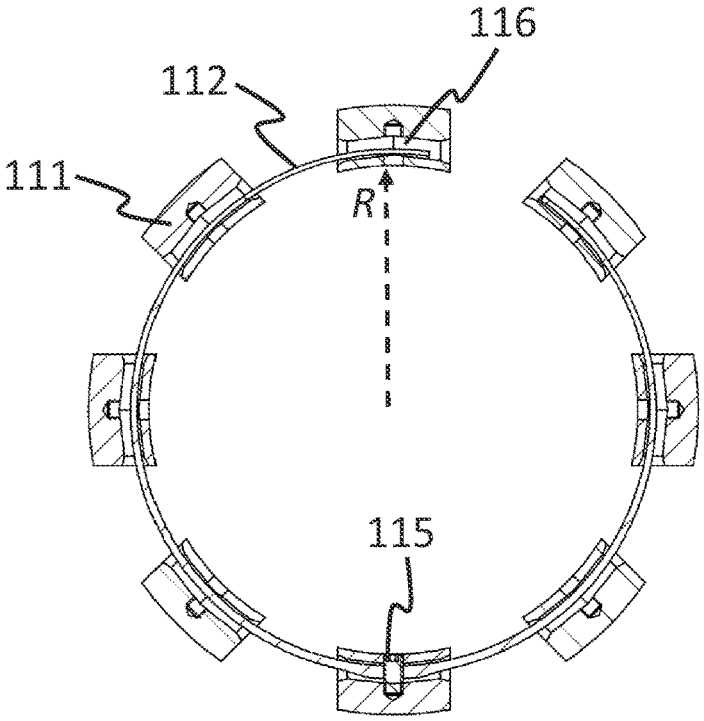
FIG. 7*b* shows a cross-section of the locking dogs and the spring element of FIG. 6*b;*

FIG. 7*a* and FIG. 7*b* show cross-sections of the locking dogs 111 and the spring element 112 of FIG. 6*a* and FIG. 6*b* respectively.

In FIG. 7*a* and FIG. 7*b* one of the locking dogs 111 are connected to the spring element 112 by means of a fastener 115. The other locking dogs 111 are slidably connected to the spring element 112. This allows the circumferential distance between the locking dogs 111 to change in response to a change in the circumference of the spring element 112.

Figure 8A:
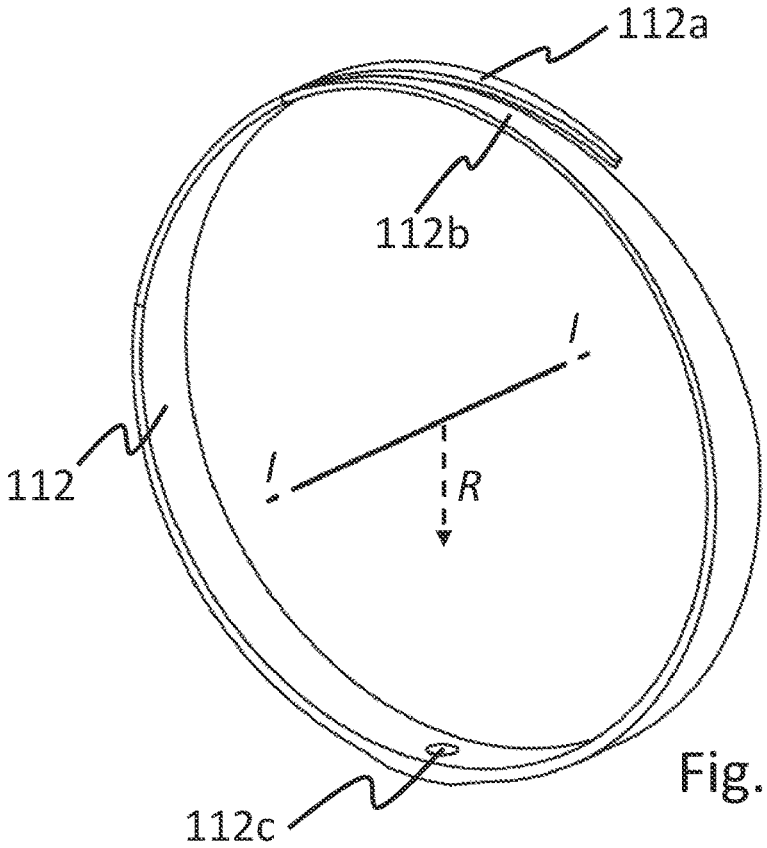
FIG. 8*a* shows a perspective view of the spring element in a typical run state.
Figure 8B:
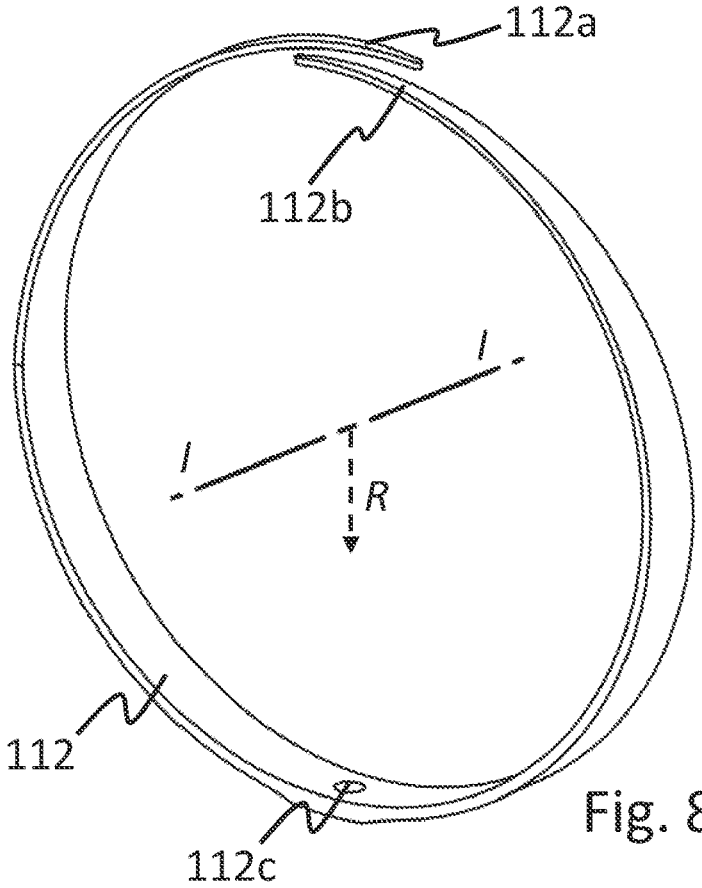
FIG. 8*b* shows a perspective view of the spring element in a typical set state.

FIG. 8*a* and FIG. 8*b* show perspective views of the spring element 112. In FIG. 8*a* the spring element 112 is in a typical run state and in FIG. 8*b* the spring element 1112 is in a typical set state.

The spring element may have a hole 112*c* for a fastener. The hole 112*c* may be arranged at a position at substantially equal distance from the first end portion 112*a* and the second end portion 112*b* of the spring element 112.

Figure 8C:
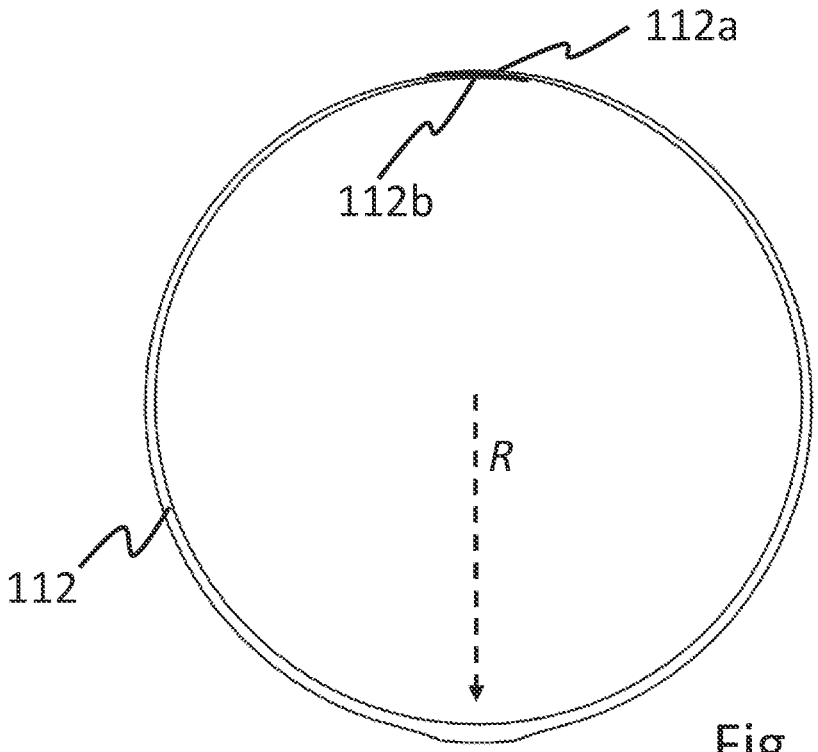
FIG. 8*c* shows a perspective view of a second embodiment of the spring element in a typical run state.
Figure 8D:
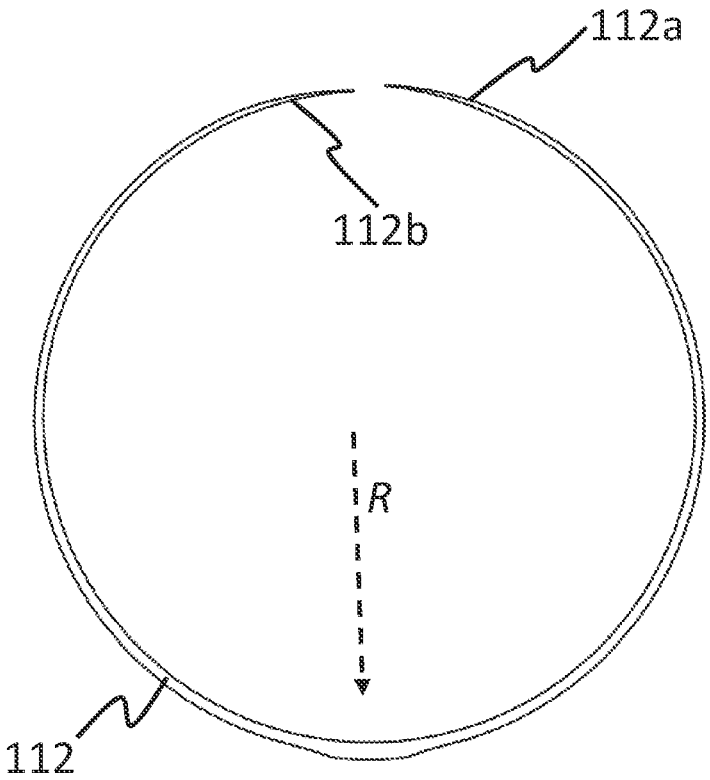
FIG. 8*d* shows a perspective view of a second embodiment of the spring element in a typical set state.

FIG. 8*c* and FIG. 8*d* show side views of a second embodiment of the spring element 112. In FIG. 8*c* the spring element 112 is in a typical run state and in FIG. 8*d* the spring element 112 is in a typical set state.

In the second embodiment of the spring element 112 the first end portion 112*a* is overlapping the second end portion 112*b* in the radial direction R, preferably in both the run state and the set state of the anchoring device 110.

Figure 9A:
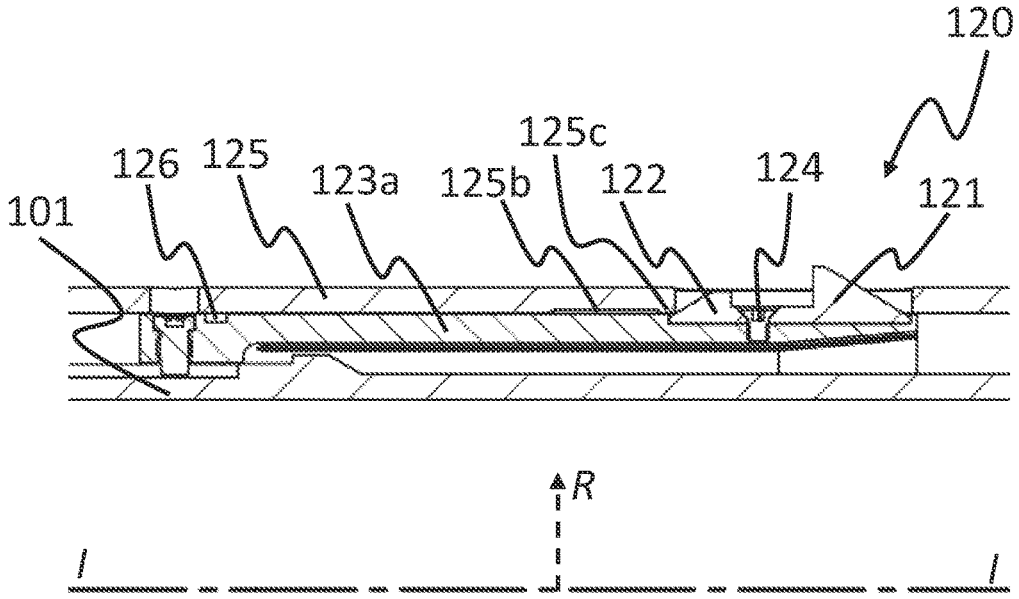
FIG. 9*a* shows a detailed cross-section of the orientation system of the well tool in the initial state.
Figure 9A:
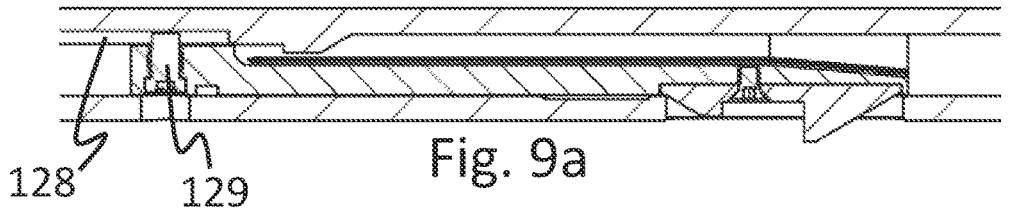
Figure 9B:
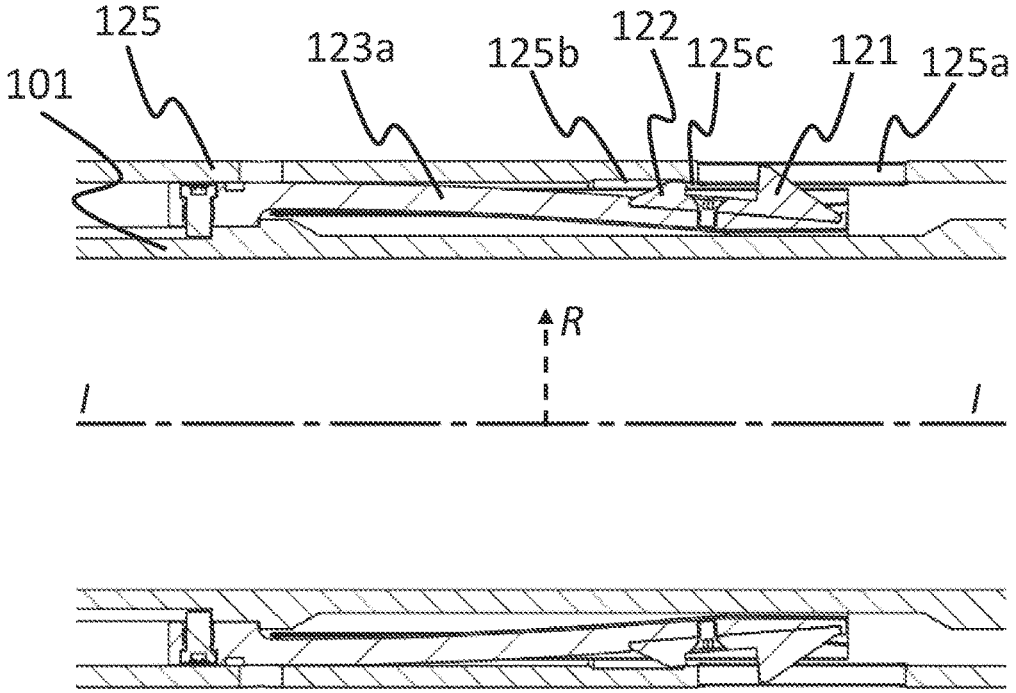
FIG. 9*b* shows a detailed cross-section of the orientation system of the well tool in the subsequent state.

FIG. 9*a* and FIG. 9*b* show cross-sections of the orientation system 120 of the well tool 100. In FIG. 9*a* the orientation system 120 is in the initial state and in FIG. 9*b* the orientation system 120 is in the subsequent state.

The well tool 100 comprises an outer housing 125 arranged radially outside the mandrel 101. The outer housing 125 has a wall thickness t.

The orientation system 120 comprises a radial opening 125*a* provided in the outer housing 125. The orientation system 120 further comprises a finger sleeve 123 comprising a longitudinally extending resilient finger 123*a* with a distal part 123*a*' and a proximal part 123" connected to the finger sleeve 123. The finger sleeve 123 is arranged radially between the mandrel 101 and the outer housing 125.

The distal part 123*a*' comprises a first wedge-shaped portion 121 and a second wedge-shaped portion 122 both extending in the outwards radial direction R and tapering away from each other in the longitudinal direction I-I.

In the initial state of the orientation system 120, the first wedge-shaped portion 121 protrudes radially through the radial opening 125*a* of the outer housing 125 and is configured to engage a guide groove 203 in an inner surface of a surrounding bore 202.

In the initial state of the orientation system 120, the first wedge-shaped portion 121 is configured to be longitudinally and rotationally guided in the guide groove 203 when the well tool 100 is moved longitudinally.

The well tool 100 is configured to rotate with the first wedge-shaped portion 121, i.e. when the wedge-shaped portion 121 rotates relative to the cement spool 200 the well tool 100 rotates correspondingly.

In the subsequent state of the orientation system 120, the first wedge-shaped portion 121 is radially retracted in the radial opening 125*a* of the outer housing 125.

In the illustrations the first wedge-shaped portion 121 and the finger sleeve 123 are separate pieces connected to each other by fastening means 124. The fastening means preferably has a predetermined shear strength.

The outer housing 125 may further comprise a retention lip 125*c* extending inwards in the radial direction R. The retention lip 125*c* is configured for engagement with the second wedge-shaped portion 122 when the orientation system 120 is in the subsequent state. The retention lip 125*c* can then retain the second wedge-shaped portion 122 to prevent the orientation system 120 returning to the initial state. The retention lip 125*c* may be a side surface of a recess 125*b* provided in an inner surface of the outer housing 125.

The orientation system 120 may comprise a guide groove 128 provided in the mandrel 101, and a guide bolt 129 arranged in the finger sleeve 123. The guide groove 128 is configured to receive the guide bolt 129 such that the two can cooperate in a guiding manner when the finger sleeve 123 is moved relative to the mandrel 101. Relative rotation of the finger sleeve 123 and the mandrel 101 can thus be controlled.

Figure 10:
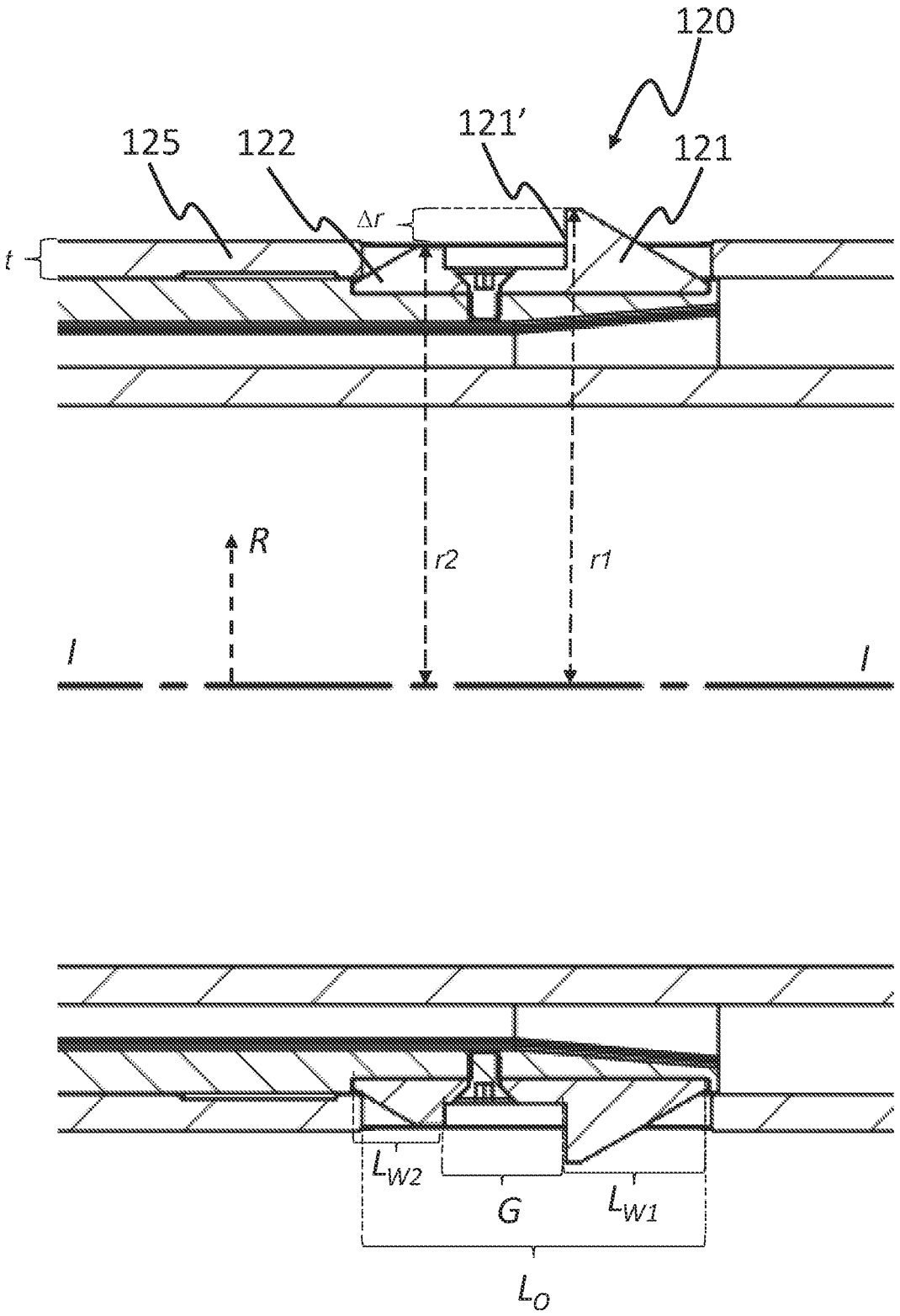
FIG. 10 shows a detailed cross-section of the orientation system of the well tool in the initial state.

FIG. 10 shows a cross-section of the orientation system 120 of the well tool 100 in the initial state.

The first wedge-shaped portion 121 has a stop surface 121' extending outwards in the radial direction R.

The radial opening 125*a* has a longitudinal length $L_O$ of at least the combined length of the first wedge-shaped portion 121 and the second wedge-shaped portion 122.

The first wedge-shaped portion 121 has a first outwards extent $r_1$ in the radial direction R, the second wedge-shaped portion 122 has a second outwards extent $r_2$ in the radial direction R. The difference Δr between the first outwards extend $r_1$ and the second outwards extent $r_2$ is less than the wall thickness t.

Figure 11:
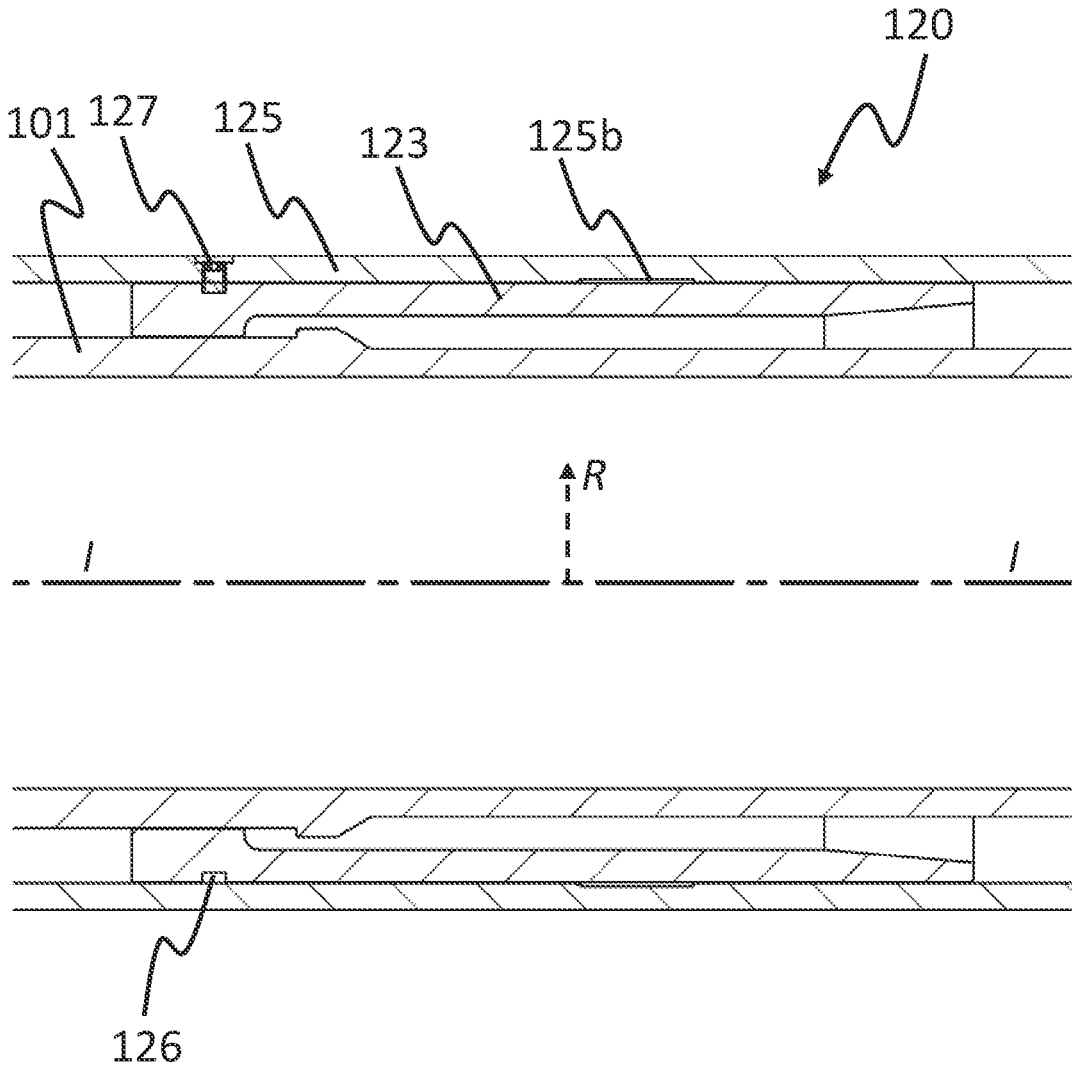
FIG. 11 shows a detailed cross-section of the orientation system of the well tool in the initial state.

FIG. 11 shows a cross-section of the orientation system 120 of the well tool 100 in the initial state. The well tool 100 may comprise a shear screw 127 connecting the outer housing 125 and the finger sleeve 123 to maintain the well tool 100 in the initial state. The shear screw 127 is held in a through hole in the outer housing 125 and enters a groove 126 in the finger sleeve 123 configured to receive the shear screw 127. The through hole is typically provided with threads.

The shear screw 127 and the guide bolt 129 may be circumferentially spaced apart 90°.

To enter the subsequent state of the well tool 100, the shear screw 127 must be applied a shear force exceeding a predetermined value. The shear force is typically applied by relative movement of the finger sleeve 123 and the outer sleeve 125. This relative movement may be caused by relative movement of the mandrel 101. The predetermined shear force value of the shear screw 127 must be sufficiently high to maintain the initial state of the well tool 100 also when the resilient finger 123 is forced radially inwards due to the first wedge-shaped portion 121 or the second wedge-shaped portion 122 sliding over a tapering surface.

Figure 12:
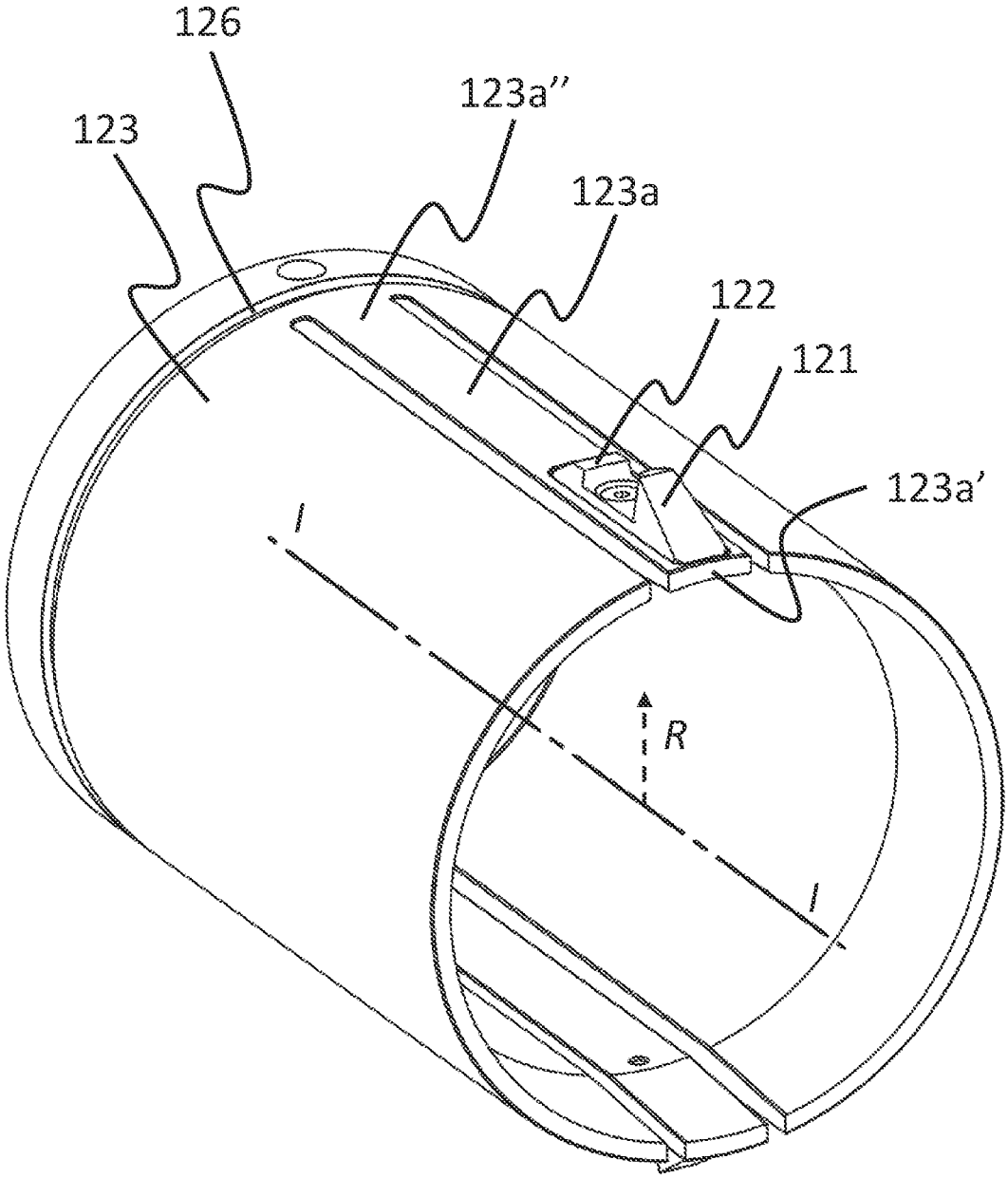
FIG. 12 shows a perspective view of a finger sleeve of the orientation system, the finger sleeve comprising a resilient finger.

FIG. 12 shows a perspective view of a finger sleeve 123 of the orientation system 120. The finger sleeve 123 comprises a resilient finger 123*a*. The resilient finger 123*a* extends in the longitudinal direction I-I of the finger sleeve 123. The resilient finger 123*a* has a distal part 123*a*' and an opposite proximal part 123".

The finger sleeve 123 may comprise two oppositely arranged resilient fingers 123*a*.

Figure 13:
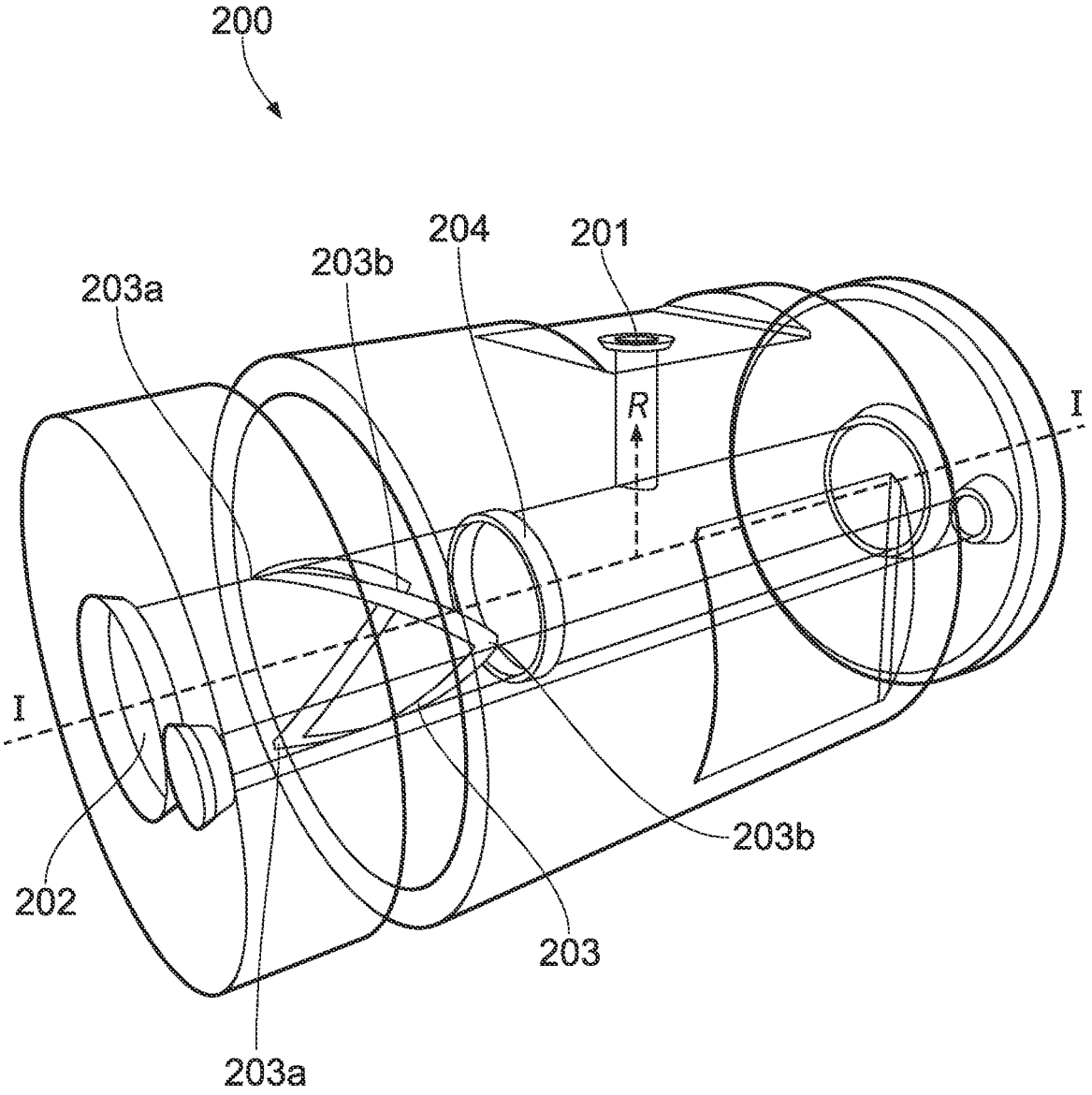
FIG. 13 shows a transparent perspective view of a spool in which the well tool can be aligned and locked.

FIG. 13 shows a transparent perspective view of a cement spool 200. The cement spool 200 has a bore 202 that may be through going. An inlet 201 may extends from the bore 202 in the radial direction R to an outside of the cement spool 200.

Figure 14:
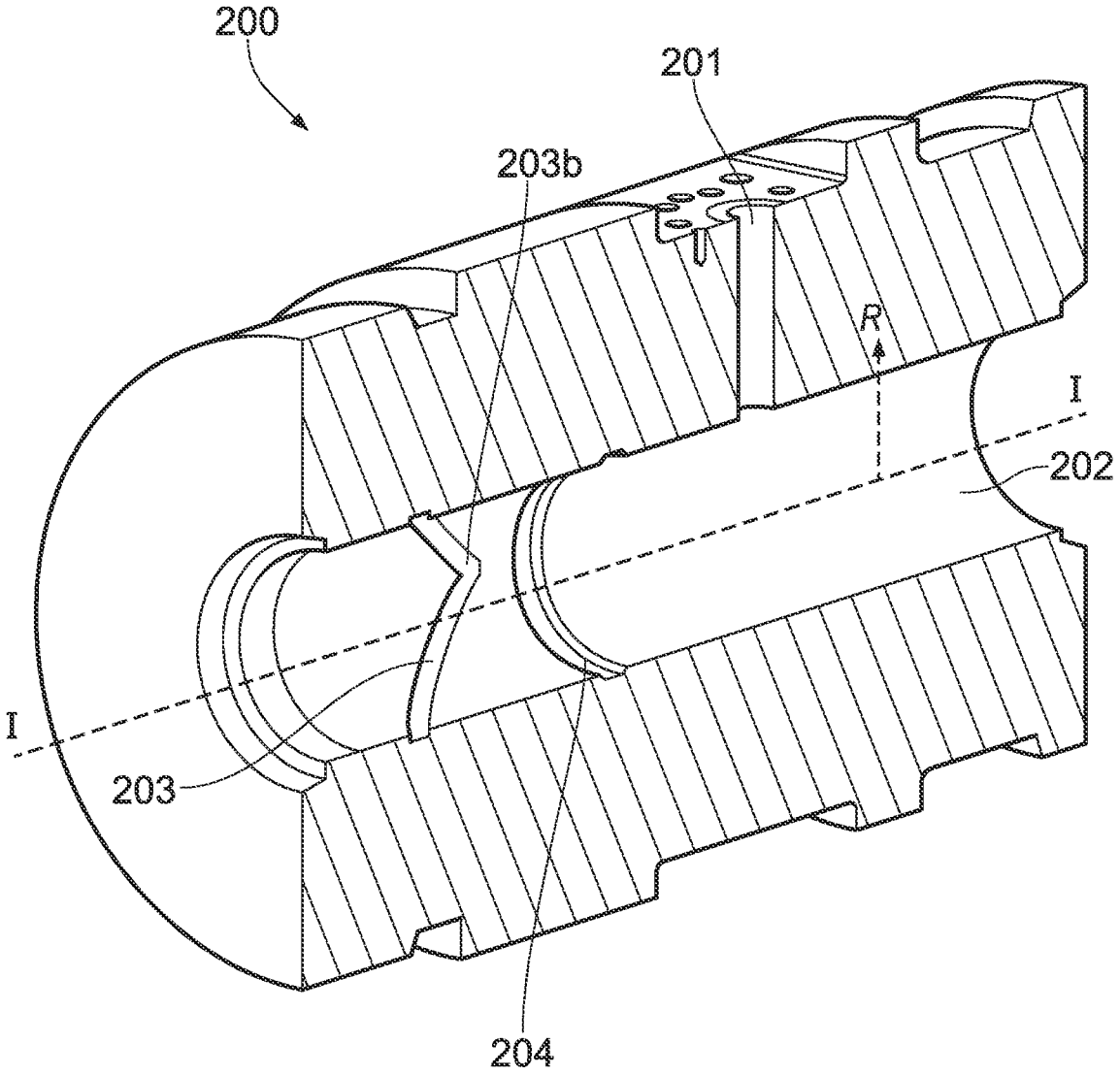
FIG. 14 shows a perspective cross-section of the spool comprising an inlet and a bore provided with a guide groove and a lock groove.

FIG. 14 shows a perspective cross-section of the cement spool 200 of FIG. 13.

The bore 202 of the cement spool 200 may be provided with a guide groove 203 configured to interact with the orientation system 120. Typically, the finger sleeve 123 will engage the guide groove 203 by means of the wedge-shaped portion 121 and follow the path of the guide groove 203 when the orientation system 120 is in the initial state. In the subsequent state, the orientation system 120 is configured to not engage the guide groove 203. The guide groove 203 preferably forms a continuous path, i.e. without a starting point and an endpoint with a gap between them. The guide groove 203 may comprise an upper point 203*a* and a lower point 203*b* that are spaced apart in the longitudinal direction I-I of the cement spool 200. The guide groove 203 may extend from the lower point 203*b* to the upper point 203*a* in a substantially helical manner. The positioning of the upper point 203*a* relative to the inlet 201 of the cement spool 200 matches the positioning of the first wedge-shaped portion 121 relative to the inlet 104 of the well tool 100 in the initial state of the orientation system 120.

The inner corners of the guide groove 203 preferably has a radius that is made as small as possible, such that the guide groove 203 has side surfaces with at least a portion extending in the radial direction R.

The bore of the cement spool 200 may be provided with a lock groove 204 configured to interact with the anchoring device 110. The lock groove 204 is configured to receive the locking dogs 111 of the anchoring device 110. The locking groove 204 preferably forms a continuous path, i.e. without a starting point and an endpoint with a gap between them.

In FIG. 13 and FIG. 14, the guide groove 203 and the lock groove 204 are arranged downstream the inlet 201, and the guide groove 203 arranged downstream the lock groove 204. This is a preferred arrangement; however, other arrangements may be possible.

The well tool 100 can be longitudinally and/or rotationally aligned in the bore 202 by configuring the orientation system 120 in the initial state; inserting the well tool 100 into the bore 202; running the well tool 100 in the inserting direction Di through the bore 202 at least until the first wedge-shaped portion 121 reaches the guide groove 203; pulling the well tool 100 with a predetermined force in the pulling direction Dp through the bore 202 while allowing the well tool 100 to swivel in the bore 202 in response to a guiding interaction between the first wedge-shaped portion 121 and the guide groove 203; and continue pulling the well tool 100 with a predetermined force in the pulling direction Dp through the bore 202 until the well tool 100 stops moving.

When the well tool 100 has stopped moving, it is aligned with the cement spool 200 and the orientation system 120 can enter the subsequent state. The subsequent state is entered by moving the outer housing 125 relative to the finger sleeve 123 until the orientation system 120 enters the subsequent state. The wedge-shaped portion 121 is then radially retracted and not longer in engagement with the guide groove 203.

As a contingency in case the subsequent state of the orientation system 120 cannot be entered, the first wedge-shaped portion 121 and the finger sleeve 123 may be separate pieces connected to each other by the fastening means 124 having a predetermined shear strength. The well tool 100 may then be retrieved from the cement spool 200 by pulling the well tool 100 in the pulling direction Dp with a force exceeding the predefined shear strength of the fastening means 124 to break the fastening means 124; and then retrieving the well tool 100 from the bore 202.

The well tool 100 can be set in the bore 202, typically after aligning the well tool 100 and the cement spool 200 as described above, by configuring the anchoring device 110 to be in the run state; inserting the well tool 100 into the bore 202; aligning the well tool 100 with the lock groove 204 of the bore 202; and setting the well tool 100 by moving the first ring 113 and the second ring 114 towards each other until the anchoring device 110 enters the set state.

The well tool 100 is preferably configured such that the subsequent state of the orientation system 110 and the set state of the anchoring device 110 can be entered simultaneously.

The well tool 100 can be released from the cement spool 200 by moving the first ring 113 and the second ring 114 away from each other until the anchoring device 110 enters the run state. Then the well tool 100 can be retrieved from the bore 202.

REFERENCE LIST

100 Well tool, locking module
101 Mandrel

102 First packer
103 Second packer
104 Inlet, in well tool
110 Anchoring device
111 Locking dog
112 Spring element
112*a* First end of spring device
112*b* Second end of spring device
112*c* Hole for fastener
113 First ring
114 Second ring
115 Fastener, for locking dogs
116 Through-hole, in locking dogs, for spring device
117 Guide sleeve, for locking dogs
118 Through-hole, in guide sleeve
120 Orientation system
121 First wedge-shaped portion
121' Stop surface of the first wedge-shaped portion
122 Second wedge-shaped portion
123 Finger sleeve
123*a* Resilient finger
123*a'* Distal part of resilient finger
123*a"* Proximal part of resilient finger
124 Fastening means, for wedge-shaped portion
125 Outer housing
125*a* Radial opening, in outer housing
125*b* Recess, in outer housing
125*c* Retention lip, in outer housing
126 Groove for shear pin, in finger sleeve
127 Shear pin
128 Guide groove
129 Guide bolt
200 Cement spool
201 Inlet, in cement spool
202 Bore, in cement spool
203 Guide groove, in bore
203*a* Upper point of guide groove
203*b* Lower point of guide groove
204 Lock groove, in bore
R Radial direction
I-I Longitudinal direction
$r_1$ Outwards radial extent of the first wedge-shaped portion
$r_2$ Outwards radial extent of the second wedge-shaped portion
$\Delta r$ difference between the outwards radial extent of the first and the second wedge-shaped portion
t wall thickness of the outer housing
$L_O$ Longitudinal length of the opening
$L_{W1}$ Longitudinal length of the first wedge-shaped portion
$L_{W2}$ Longitudinal length of the second wedge-shaped portion
$D_R$ Longitudinal distance between the first wedge-shaped portion and the second wedge-shaped portion in the run state of the anchoring device
$D_S$ Longitudinal distance between the first wedge-shaped portion and the second wedge-shaped portion in the set state of the anchoring device
G Longitudinal gap between the first wedge-shaped portion and the second wedge-shaped portion
$D_i$ Inserting direction
$D_p$ Pulling direction

The invention claimed is:

1. A well tool system for performing an operation in an oil/gas well, wherein the well tool system comprises:

a well tool for performing an operation in an oil/gas well, wherein the well tool comprises:

a mandrel having a longitudinal direction and a radial direction perpendicular to the longitudinal direction; and an anchoring device for longitudinally locking the well tool to a bore comprising a lock groove;

wherein the anchoring device comprises:

a first ring arranged radially outside the mandrel;

a second ring arranged radially outside the mandrel at a longitudinal distance from the first ring and movable in the longitudinal direction relative to the first ring;

a spring element being substantially ring-shaped and arranged radially outside the mandrel; and a plurality of locking dogs distributed circumferentially on the spring element and located longitudinally between the first ring and the second ring;

wherein the anchoring device has a run state in which the first ring and the second ring are provided at an initial longitudinal distance from each other;

wherein the anchoring device has a set state in which the first ring and the second ring are provided at a shorter distance from each other, thereby wedging the locking dogs outwards in the radial direction; and wherein the spring element is configured to bias the locking dogs inwards in the radial direction towards the run state of the anchoring device, wherein the well tool is a cement spool straddle; and a cement spool; wherein the cement spool comprises:

a bore extending in a longitudinal direction of the cement spool and configured to receive the well tool; and a lock groove circumferentially provided in the bore and configured to receive the plurality of locking dogs of the well tool.

2. The well tool system according to claim 1, wherein the well tool further comprises:

an outer housing arranged radially outside the mandrel;

an orientation system for longitudinal and rotational orientation of the well tool when inserted into a bore comprising a guide groove;

wherein the orientation system comprises:

a radial opening provided in the outer housing;

a finger sleeve comprising a longitudinally extending resilient finger with a distal part and a proximal part connected to the finger sleeve; wherein the finger sleeve is arranged radially between the mandrel and the outer housing;

wherein the distal part comprises a first wedge-shaped portion and a second wedge-shaped portion both extending in the outwards radial direction and tapering away from each other in the longitudinal direction;

wherein the orientation system has an initial state in which the first wedge-shaped portion protrudes radially through the radial opening of the outer housing and is configured to engage a guide groove in an inner surface of a surrounding bore;

wherein the first wedge-shaped portion is configured to be longitudinally and rotationally guided in the guide groove when the well tool is moved longitudinally;

wherein the well tool is configured to rotate with the first wedge-shaped portion;

wherein the orientation system has a subsequent state in which the first wedge-shaped portion is radially retracted in the radial opening of the outer housing; and wherein the well tool further comprises an inlet extending in the radial direction; and wherein the cement spool further comprises:

an inlet extending from the bore in the radial direction to an outside of the cement spool; and a guide groove provided in an inner surface of the bore and configured to receive and guide the first wedge-shaped portion of the well tool;

wherein the guide groove comprises an upper point and a lower point that are spaced apart in the longitudinal direction of the cement spool;

wherein the guide groove extends from the lower point to the upper point in a substantially helical manner; and wherein a positioning of the upper point relative to the inlet of the cement spool matches the positioning of the first wedge-shaped portion relative to the inlet of the well tool in the initial state of the orientation system.

3. A method for setting a well tool in a bore with a guide groove, wherein the well tool is a well tool for performing an operation in an oil/gas well, wherein the well tool comprises:

a mandrel having a longitudinal direction and a radial direction perpendicular to the longitudinal direction; and an anchoring device for longitudinally locking the well tool to a bore comprising a lock groove;

wherein the anchoring device comprises:

a first ring arranged radially outside the mandrel;

a second ring arranged radially outside the mandrel at a longitudinal distance from the first ring and movable in the longitudinal direction relative to the first ring;

a spring element being substantially ring-shaped and arranged radially outside the mandrel; and a plurality of locking dogs distributed circumferentially on the spring element and located longitudinally between the first ring and the second ring;

wherein the anchoring device has a run state in which the first ring and the second ring are provided at an initial longitudinal distance from each other; and wherein the anchoring device has a set state in which the first ring and the second ring are provided at a shorter distance from each other, thereby wedging the locking dogs outwards in the radial direction;

wherein the spring element is configured to bias the locking dogs inwards in the radial direction towards the run state of the anchoring device, wherein the method comprises:

configuring the anchoring device to be in the run state;

inserting the well tool into a bore comprising an inner surface provided with a lock groove;

aligning the well tool with the lock groove of the bore; and setting the well tool by moving the first ring and the second ring towards each other until the anchoring device enters the set state.

4. The method according to claim 3, wherein the well tool further comprises:

an outer housing arranged radially outside the mandrel;

an orientation system for longitudinal and rotational orientation of the well tool when inserted into a bore comprising a guide groove;

wherein the orientation system comprises:

a radial opening provided in the outer housing;

a finger sleeve comprising a longitudinally extending resilient finger with a distal part and a proximal part connected to the finger sleeve; wherein the finger sleeve is arranged radially between the mandrel and the outer housing;

wherein the distal part comprises a first wedge-shaped portion and a second wedge-shaped portion both extending in the outwards radial direction and tapering away from each other in the longitudinal direction;

wherein the orientation system has an initial state in which the first wedge-shaped portion protrudes radially through the radial opening of the outer housing and is configured to engage a guide groove in an inner surface of a surrounding bore;

wherein the first wedge-shaped portion is configured to be longitudinally and rotationally guided in the guide groove when the well tool is moved longitudinally;

wherein the well tool is configured to rotate with the first wedge-shaped portion;

wherein the orientation system has a subsequent state in which the first wedge-shaped portion is radially retracted in the radial opening of the outer housing;

wherein the aligning of the well tool with the lock groove of the bore comprises:

configuring the orientation system to be in the initial state;

running the well tool in an inserting direction through the bore at least until the first wedge-shaped portion reaches the guide groove of the bore;

pulling the well tool with a predetermined force in a pulling direction through the bore while allowing the well tool to swivel in the bore in response to a guiding interaction between the first wedge-shaped portion and the guide groove of the bore; and continue pulling the well tool with a predetermined force in the pulling direction through the bore until the well tool stops moving.

5. The method according to claim 4, wherein the outer housing and the first ring or the second ring are configured for simultaneous movement and adapted for simultaneous activation of the subsequent state of a locating finger mechanism and the set state of the anchoring device; wherein the setting of the well tool comprises: setting the well tool by moving the first ring and the second ring towards each other until the orientation system enters the subsequent state and the anchoring device enters the set state.

6. The method according to claim 3, wherein the method comprises:

releasing the well tool by moving the first ring and the second ring away from each other until the anchoring device enters the run state; and retrieving the well tool from the bore.

* * * * *